US010710382B2

(12) United States Patent
Ishihara et al.

(10) Patent No.: US 10,710,382 B2
(45) Date of Patent: Jul. 14, 2020

(54) PRINTING APPARATUS

(71) Applicant: Roland DG Corporation, Hamamatsu-shi, Shizuoka (JP)

(72) Inventors: Masanori Ishihara, Hamamatsu (JP); Yuta Fujisawa, Hamamatsu (JP); Toyohisa Nakao, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/536,610

(22) Filed: Aug. 9, 2019

(65) Prior Publication Data

US 2020/0047521 A1 Feb. 13, 2020

(30) Foreign Application Priority Data

Aug. 10, 2018 (JP) ..... 2018-151223
Aug. 10, 2018 (JP) ..... 2018-151224

(51) Int. Cl.
*B41J 11/00* (2006.01)
*B41J 2/21* (2006.01)
(Continued)

(52) U.S. Cl.
CPC ..... *B41J 11/002* (2013.01); *B41J 2/04* (2013.01); *B41J 2/2114* (2013.01); *B41J 11/44* (2013.01); *B41J 29/38* (2013.01)

(58) Field of Classification Search
CPC ..... B41J 11/002; B41J 29/38; B41J 2/2114; B41J 2/04; B41J 11/44
(Continued)

(56) References Cited

U.S. PATENT DOCUMENTS 8,393,700 B2 3/2013 Otsuka et al.
8,888,270 B2 * 11/2014 Kachi ..... B41J 11/002 347/102
9,375,951 B2 * 6/2016 Tsuchiya ..... C09D 11/101

FOREIGN PATENT DOCUMENTS

JP 5041611 B2 10/2012
JP 2015-063057 A 4/2015

* cited by examiner

*Primary Examiner* — An H Do
(74) *Attorney, Agent, or Firm* — Keating & Bennett, LLP

(57) ABSTRACT

A printing apparatus includes a feeder that feeds a medium in a feeding direction, a head including a row of nozzles arranged side by side in the feeding direction and movable in a scanning direction, an irradiator that radiates light onto a region longer in the feeding direction than the nozzle row and that is movable in the scanning direction together with the head, and a controller that alternatingly causes the head to move in the scanning direction and concurrently the nozzles to discharge ink while causing the irradiator to radiate the light, and the feeder to feed the medium in the feeding direction. The controller is capable of dividing the nozzle row into an upstream-side nozzle row and a downstream-side nozzle row located on a downstream side in the feeding direction from the upstream-side nozzle row, and individually controlling discharge of ink from the nozzles of each of the upstream-side nozzle row and the downstream-side nozzle row. The controller is capable of dividing the irradiator into an upstream-side irradiator, an intermediate irradiator adjacent to the upstream-side irradiator on a downstream side in the feeding direction, and a printless region irradiator adjacent to the intermediate irradiator on a downstream side in the feeding direction, and individually controlling lighting and extinguishing of each of the irradiators defined by the division.

9 Claims, 20 Drawing Sheets

(51) Int. Cl.
*B41J 29/38* (2006.01)
*B41J 2/04* (2006.01)
*B41J 11/44* (2006.01)

(58) Field of Classification Search
USPC ..... 347/9, 12, 101, 102, 104
See application file for complete search history.

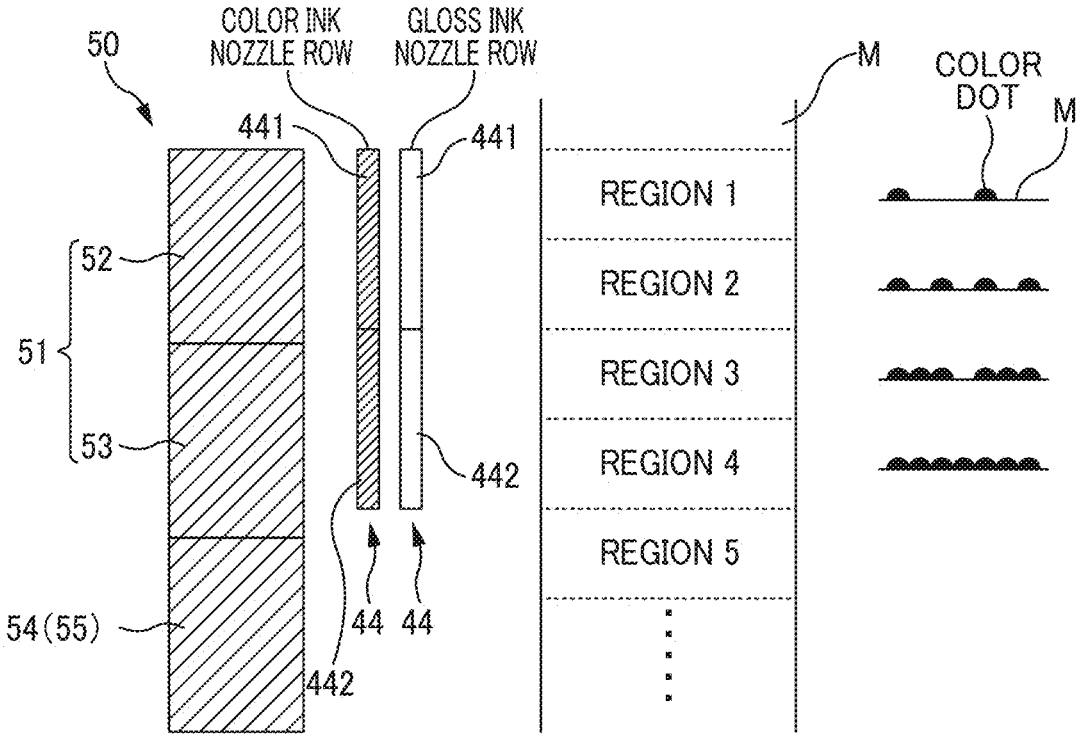
FIG. 10A (COLOR PRINTING MODE)
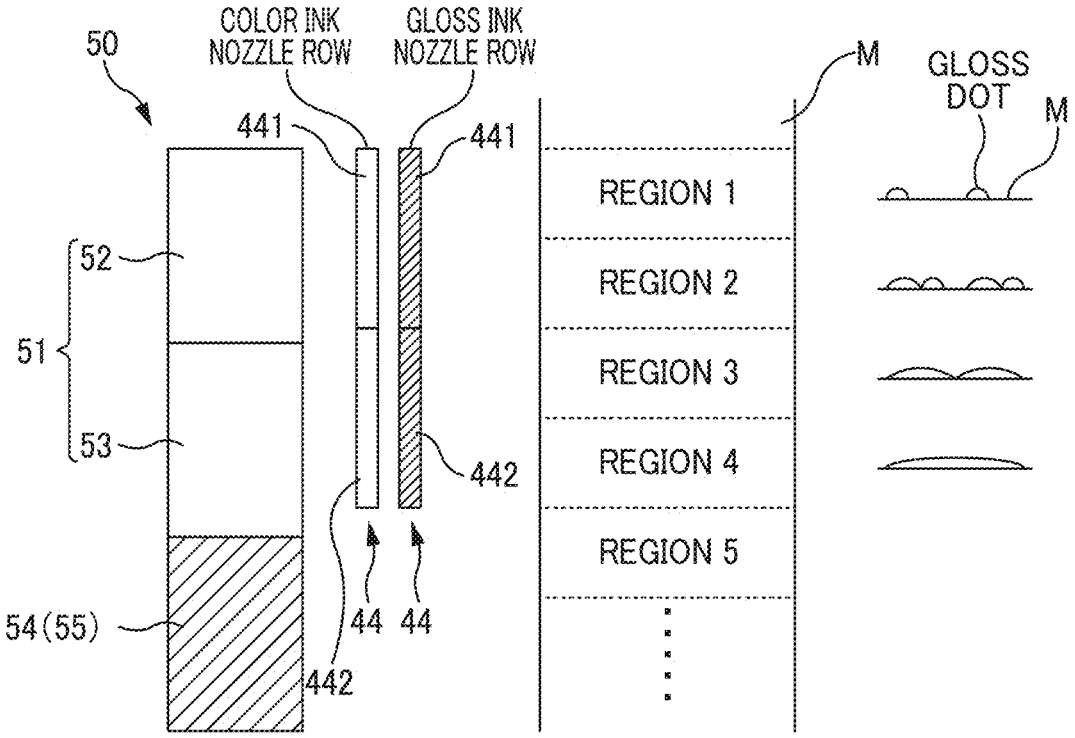
FIG. 10B (GLOSS PRINTING MODE)

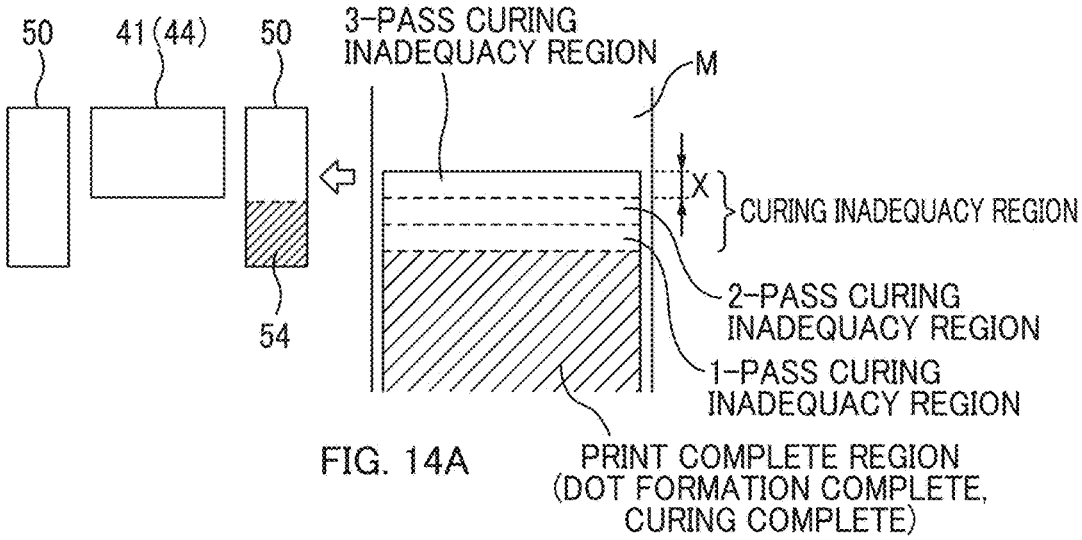
FIG. 14A
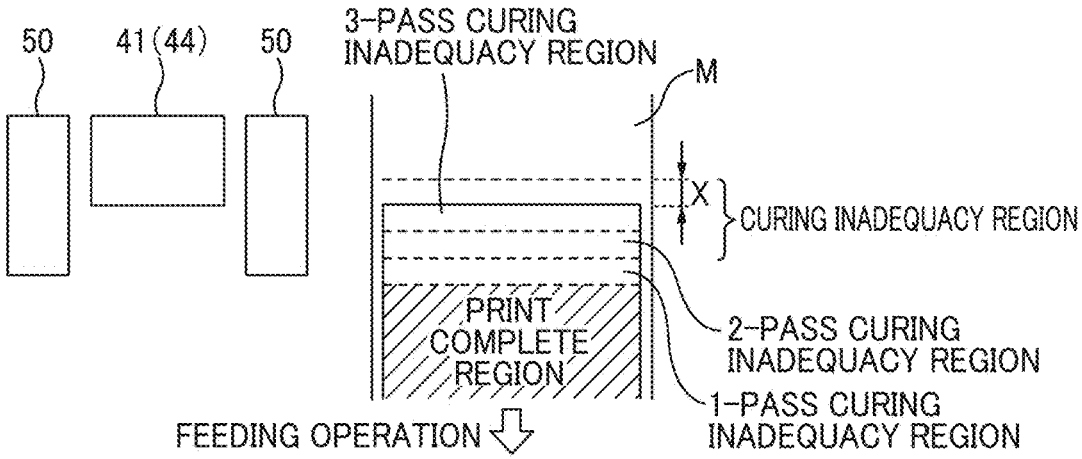
FIG. 14B (REFERENCE EXAMPLE)
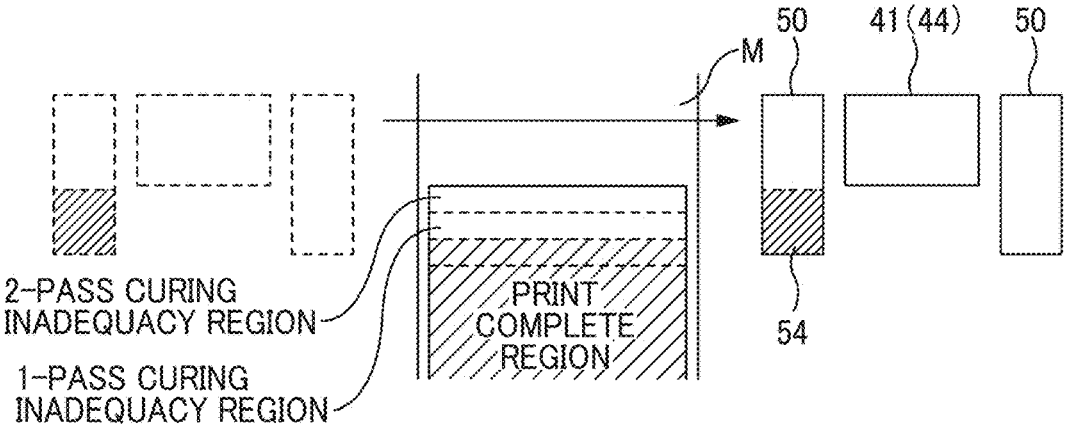
FIG. 14C (REFERENCE EXAMPLE)

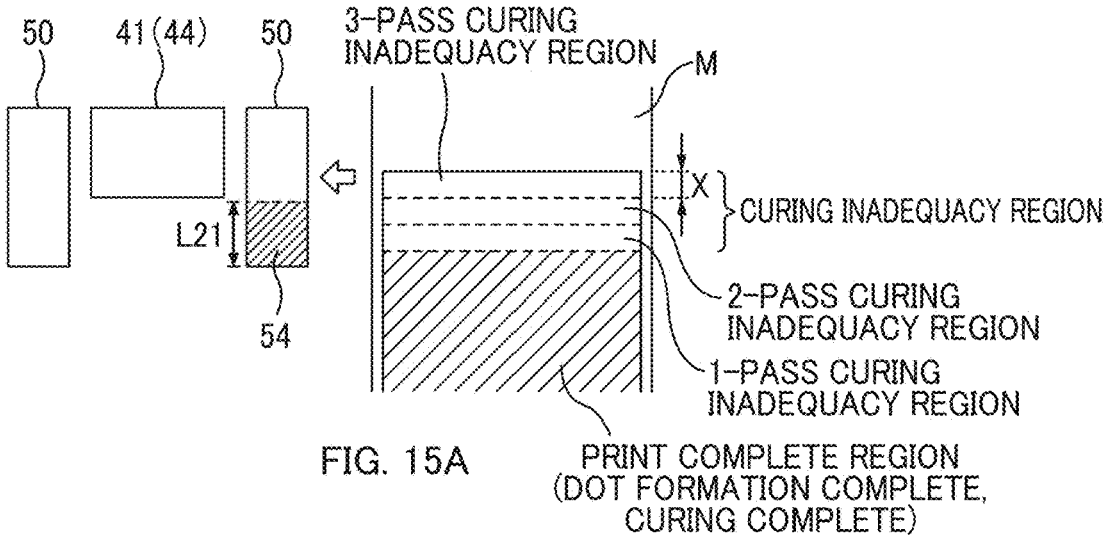
FIG. 15A
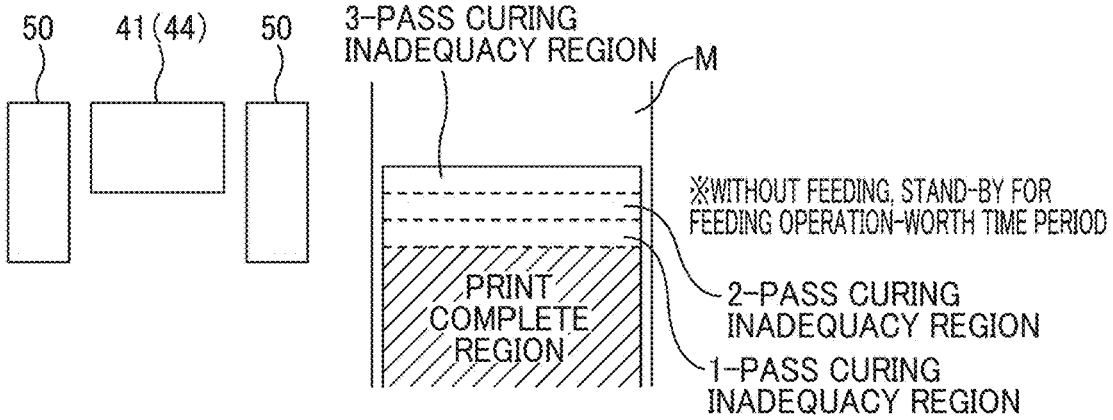
FIG. 15B (THIS PREFERRED EMBODIMENT)
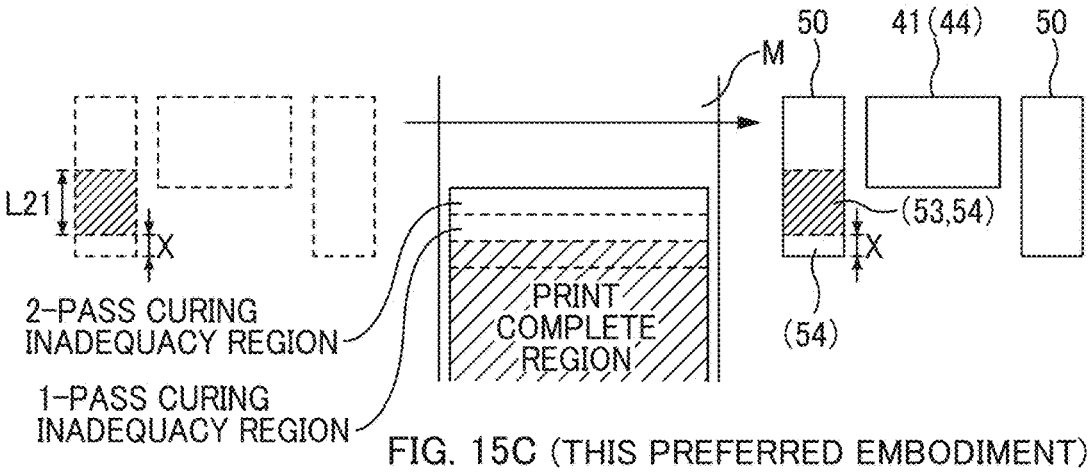
FIG. 15C (THIS PREFERRED EMBODIMENT)

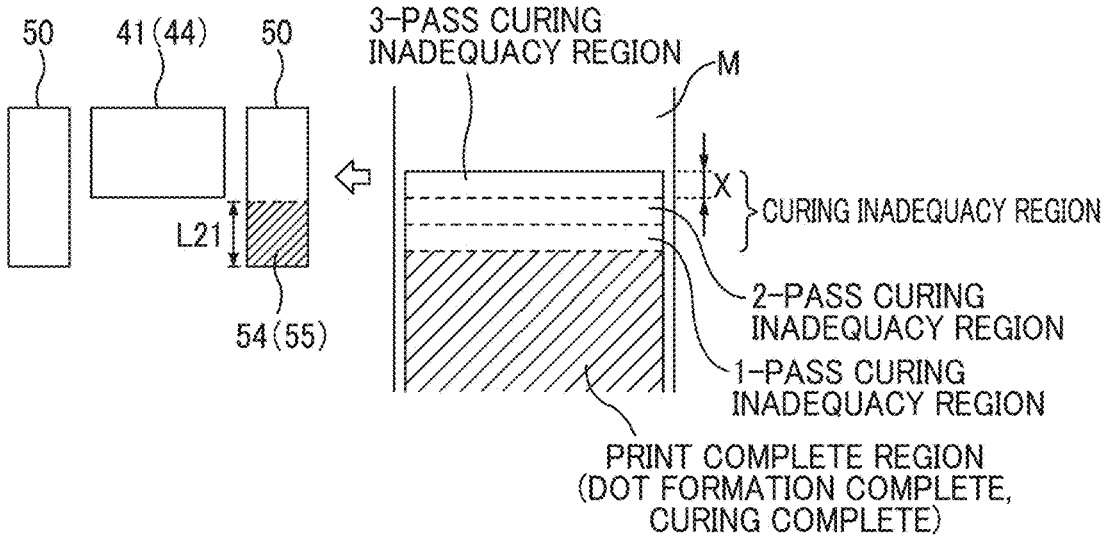
FIG. 16A (PASS FOR LAST DOT FORMATION)
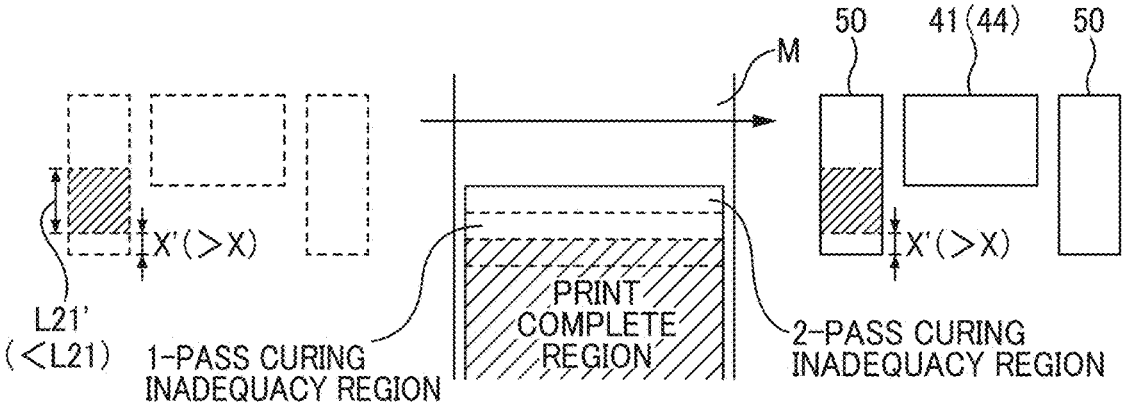
FIG. 16B (FIRST TERMINAL PASS)
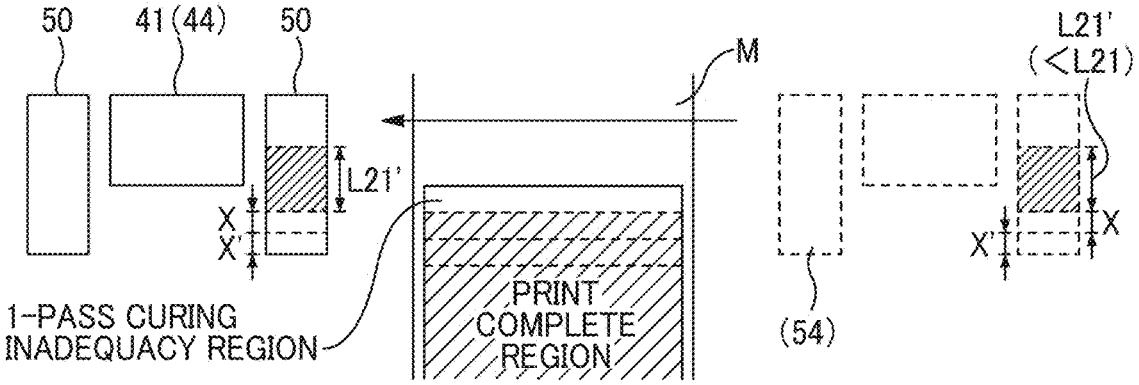
FIG. 16C (SECOND TERMINAL PASS)

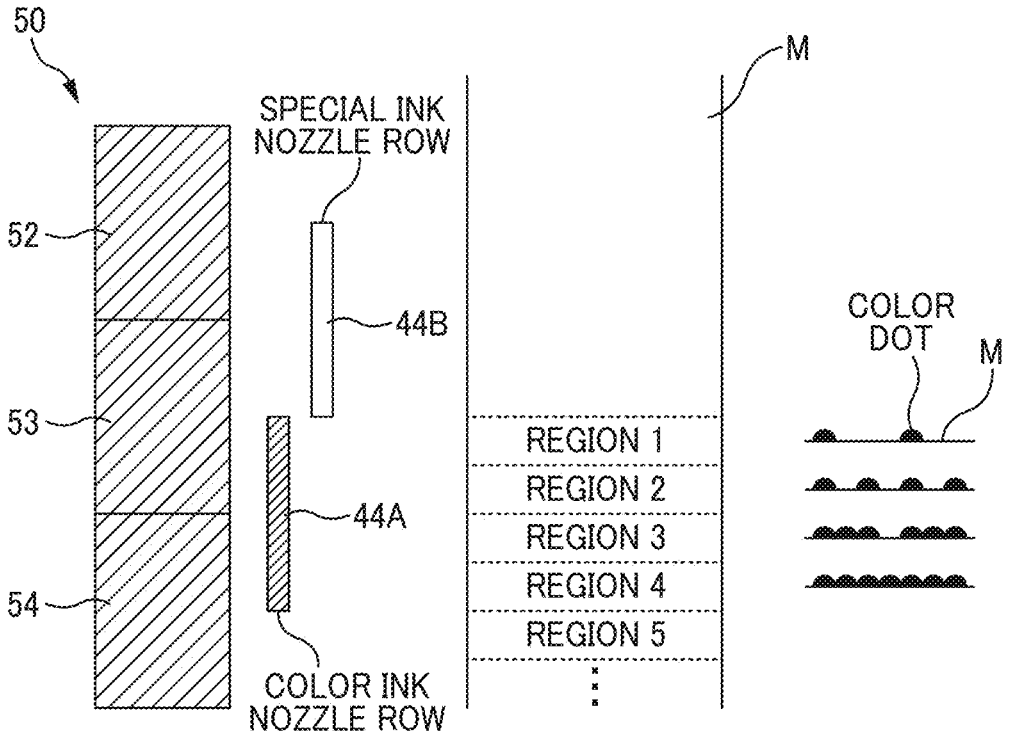
FIG. 20A (COLOR PRINTING MODE)
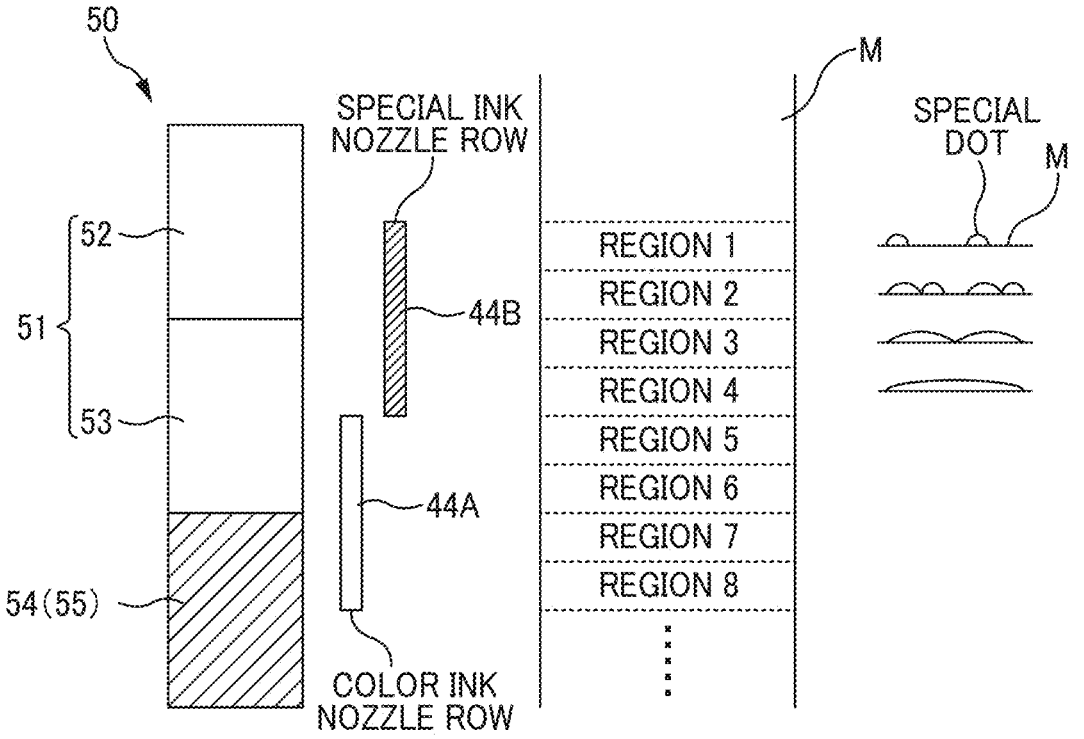
FIG. 20B (SPECIAL PRINTING MODE)

PRINTING APPARATUS

CROSS REFERENCE TO RELATED APPLICATIONS

This application claims the benefit of priority to Japanese Patent Application No. 2018-151223 filed on Aug. 10, 2018 and Japanese Patent Application No. 2018-151224 filed on Aug. 10, 2018. The entire contents of these applications are hereby incorporated herein by reference.

BACKGROUND OF THE INVENTION

1. Field of the Invention

The present invention relates to a printing apparatus.

2. Description of the Related Art

An inkjet printer is a known example of printing apparatuses. Japanese Patent No. 5041611 and Japanese Patent Application Publication No. 2015-63057 disclose inkjet printers (so-called "UV printers") which discharge ultraviolet (UV) curable ink onto a medium and irradiate dots formed on the medium with UV to cure the dots.

When an irradiation unit, which is side by side in a scanning direction with a nozzle row for discharging ink, is lit so as to cure dots immediately after formation, ink bleed can be reduced. However, when dots immediately after formation are cured, a surface of a printed image becomes rough, resulting in the image lacking glossiness. Meanwhile, when the irradiation unit that is side by side with the nozzle row is extinguished and an irradiation unit disposed on a downstream side in a feeding direction is lit so as to radiate light onto and cure dots after a predetermined time period has elapsed after formation of the dots, the dots can be smoothened and glossiness can be enhanced. In this case, however, image quality may degrade due to ink bleed.

SUMMARY OF THE INVENTION

Preferred embodiments of the present invention perform printing by mixing dots cured immediately after dot formation by light irradiation and dots (smoothened dots) cured by light irradiation after a lapse of a certain time period after dot formation. Moreover, preferred embodiments of the present invention provide methods and apparatuses in which an adequate time period extending from after dot formation up to light irradiation is provided to smoothen the dots.

A printing apparatus according to a preferred embodiment of the present invention includes a feeder that feeds a medium in a feeding direction, a head that at least includes a nozzle row in which a plurality of nozzles is located side by side in the feeding direction and that is movable in a scanning direction, an irradiator that radiates light onto a region longer in the feeding direction than the nozzle row and that is movable in the scanning direction together with the head, and a controller that causes, in alternating fashion, the head to move in the scanning direction and concurrently the nozzles to discharge ink while causing the irradiator to radiate the light, and the feeder to feed the medium in the feeding direction, wherein the controller is capable of dividing the nozzle row into an upstream-side nozzle row and a downstream-side nozzle row located on a downstream side in the feeding direction from the upstream-side nozzle row, and individually controlling discharge of ink from the nozzles of each of the upstream-side nozzle row and the downstream-side nozzle row, the controller is capable of dividing the irradiator into an upstream-side irradiator, an intermediate irradiator adjacent to the upstream-side irradiator on a downstream side in the feeding direction, and a printless region irradiator adjacent to the intermediate irradiator on a downstream side in the feeding direction, and individually controlling lighting and extinguishing of each of the irradiators defined by the division, the upstream-side irradiator overlaps a range of the upstream-side nozzle row in the feeding direction, the intermediate irradiator overlaps a range of the downstream-side nozzle row in the feeding direction, the printless region irradiator is located farther on a downstream side in the feeding direction than the downstream-side nozzle row without overlapping the range of the downstream-side nozzle row in the feeding direction, and the controller performs, in alternating fashion, an operation and control to cause the feeder to feed the medium in the feeding direction, the operation including causing the head to move in the scanning direction and concurrently causing the nozzles of the upstream-side nozzle row and the downstream-side nozzle row to discharge ink, while having the upstream-side irradiator lit, the intermediate irradiator extinguished, and the printless region irradiator lit.

When color inks are discharged to print a color image on a medium, image quality of the color image is enhanced if bleeding of color dots formed with the color inks is limited. Thus, it is preferable to light the irradiator that is side by side in the scanning direction with a nozzle row discharging color inks to cure the dots immediately after formation. On the other hand, when clear ink (gloss ink) is discharged to enhance glossiness of a medium, it is preferable to allow a predetermined time period to elapse after formation of dots to smoothen the dots. For this purpose, it is preferable to extinguish the irradiator that is side by side with the nozzle row and light the irradiator that is disposed on a downstream side in the feeding direction. However, even when the irradiator that is side by side with the nozzle row is extinguished in order to smoothen the clear ink, if light radiated from the irradiator on the downstream side in the feeding direction leaks to a printing region, then dots formed with the clear ink end up being irradiated with light immediately after formation, and as a result, the dots may be cured before being smoothened. In addition, it may be preferable to smoothen dots also when a ground of a medium is processed using clear ink. Moreover, when special inks other than clear ink, such as white ink or silver ink, are discharged onto a medium, it may be preferable to smoothen the dots. Also when it is intended to smoothen dots formed with such special inks (clear ink, white ink, etc.), the dots may be cured before being smoothened even if the irradiator that is side by side with the nozzle row is extinguished, similarly to what has been described above.

Another preferred embodiment of the present invention limits light irradiation of dots, which are formed with special ink, immediately after formation.

A printing apparatus according to another preferred embodiment of the present invention includes a feeder that feeds a medium in a feeding direction, a head that at least includes a nozzle row in which a plurality of nozzles are located side by side in the feeding direction and that is movable in a scanning direction, an irradiator that radiates light onto a region longer in the feeding direction than the nozzle row and that is movable in the scanning direction together with the head, and a controller that causes, in alternating fashion, the head to move in the scanning direction and concurrently the nozzles to discharge ink while causing the irradiator to radiate the light, and the feeder to feed the medium in the feeding direction, wherein the nozzle row at least includes a color ink nozzle row that discharges color ink and a special ink nozzle row that discharges special ink, the controller is capable of dividing the irradiator into a printing region irradiator and a printless region irradiator adjacent to the printing region irradiator on a downstream side in the feeding direction and individually controlling lighting and extinguishing of each of the irradiators defined by the division, when the special ink is discharged from the nozzles of the special ink nozzle row, the printing region irradiator encompasses a range of the special ink nozzle row in the feeding direction, at least a portion of the printing region irradiator on a downstream side in the feeding direction is disposed farther on a downstream side in the feeding direction than a downstream end of the special ink nozzle row in the feeding direction, the printless region irradiator is located farther on a downstream side in the feeding direction than a downstream end of the nozzle row in the feeding direction, and when causing the nozzles of the special ink nozzle row to discharge the special ink, the controller extinguishes the printing region irradiator and lights the printless region irradiator.

Other features of preferred embodiments of the present invention will be revealed through the description in this specification.

According to preferred embodiments of the present invention, it is possible to implement printing by mixing dots cured immediately after dot formation by light irradiation and dots (smoothened dots) cured by light irradiation after a lapse of a certain time period after dot formation, and it is also possible to provide an adequate time period extending from after dot formation up to light irradiation to smoothen the dots.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 10A is an explanatory diagram illustrating a way dots are formed in color printing mode, and FIG. 10B is an explanatory diagram illustrating a manner in which dots are formed in gloss printing mode.

FIGS. 14A through 14C are explanatory diagrams of terminal processing in a reference example.

FIGS. 15A through 15C are explanatory diagrams of terminal processing according to a preferred embodiment of the present invention.

FIGS. 16A through 16C are explanatory diagrams of terminal processing in a modification of a preferred embodiment of the present invention.

FIG. 20A is an explanatory diagram illustrating a manner in which dots are formed in color printing mode of the reference example, and FIG. 20B is an explanatory diagram of a manner in which dots are formed in a special printing mode of the reference example.

DETAILED DESCRIPTION OF THE PREFERRED EMBODIMENTS

First Preferred Embodiment

Figure 1:
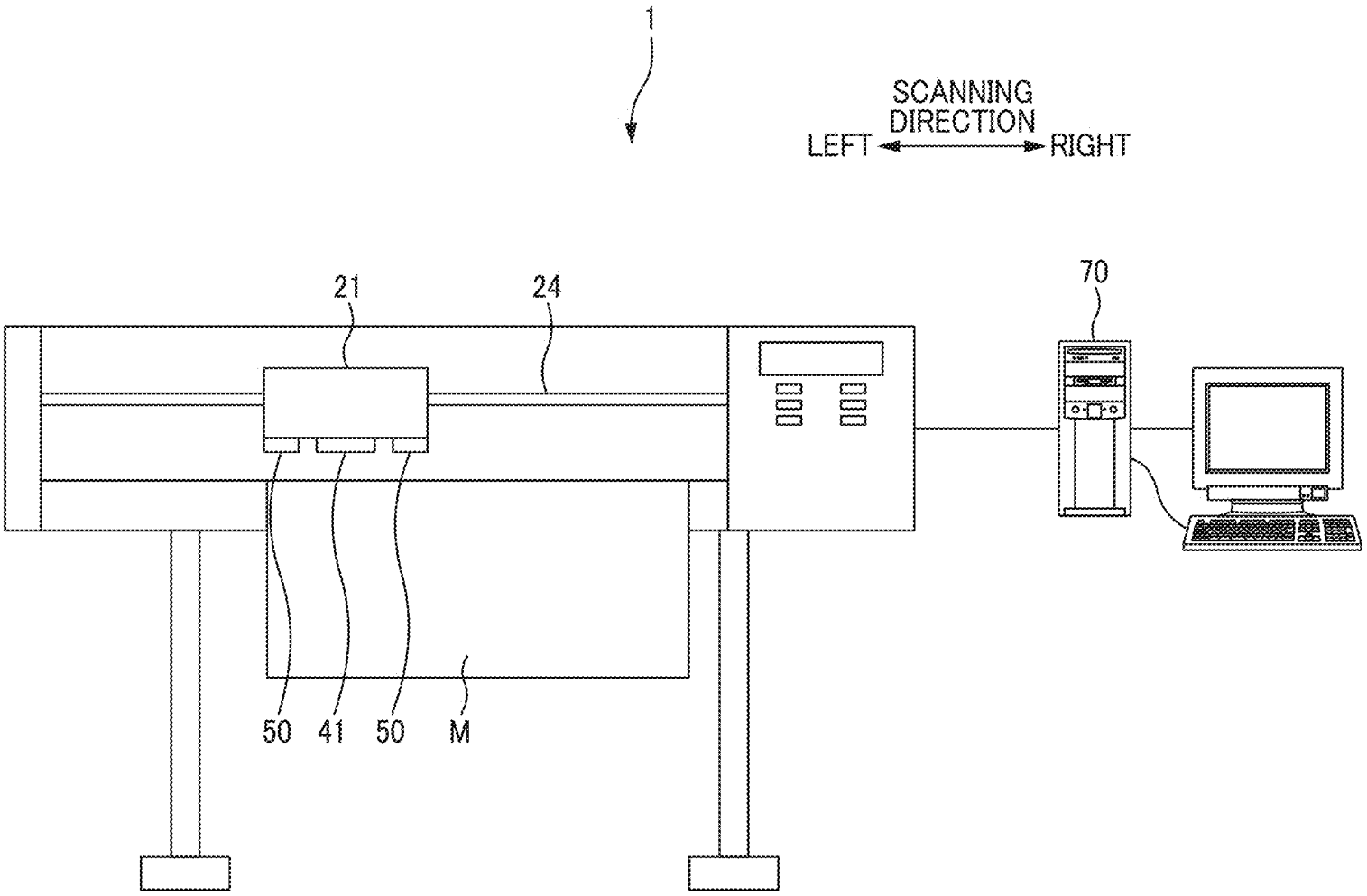
FIG. 1 is a schematic explanatory diagram of a printing system 100 according to a preferred embodiment of the present invention.

FIG. 1 is a schematic explanatory diagram of a printing system 100 according to a first preferred embodiment of the present invention.

Figure 2:
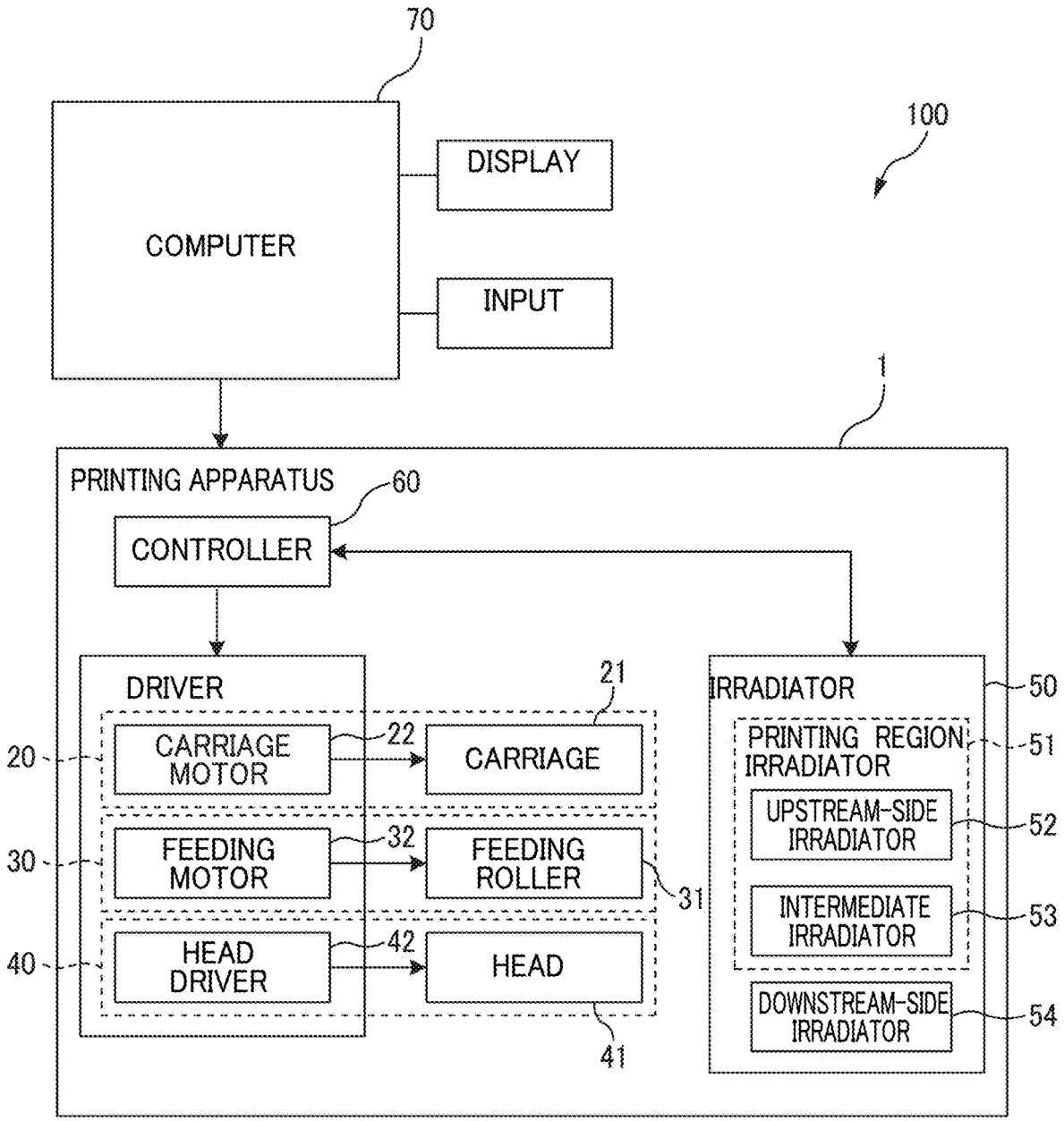
FIG. 2 is a block diagram of the printing system 100.

FIG. 2 is a block diagram of the printing system 100.

In the description below, a direction in which a carriage 21 moves may be referred to as a "scanning direction" or "left-right direction". In addition, a direction in which a medium M moves may be referred to as a "feeding direction", a side from which the medium M is supplied may be referred to as "upstream (upstream side)", and a side to which the medium M after printing is discharged may be referred to as "downstream (downstream side)".

The printing system 100 is a system configured or programmed to, for example, carry out printing by discharging ink droplets onto a medium M. The printing system 100 may include a printing apparatus 1 and a computer 70. Note that the printing system 100 may be constituted by a single printing apparatus given that the printing apparatus 1 implements the functions of the computer 70.

The computer 70 is a printing controller to, for example, control the printing apparatus 1. The computer 70 may generate a command code to control the printing apparatus 1 and send the command code to the printing apparatus 1. The printing apparatus 1 having received the command code from the computer 70 may control relevant elements or portions in accordance with the command code to carry out printing on the medium M (will be described later). The computer 70 may be, for example, a general-purpose personal computer 70, and may have a printing control program (so-called "printer driver") installed therein. A central processing unit (CPU) of the computer 70 may function as a printing controller to generate the command code as a result of the printing control program (so-called "printer driver") being executed.

The printing apparatus 1 is an apparatus to, for example, carry out printing by discharging ink droplets on the medium M. The printing apparatus 1 in this preferred embodiment is a UV printer that discharges UV curable ink (so-called "UV ink") on the medium M and cures dots formed on the medium M by irradiating the dots with UV. The printing apparatus 1 in this preferred embodiment may include a carriage 20, a feeder 30, a printer 40, an irradiator 50, and a controller 60.

The carriage 20 is structured to, for example, move the carriage 21 reciprocally in the scanning direction (left-right direction). The carriage 20 may include the carriage 21, a carriage motor 22, and a carriage guide 24. The carriage 21 may be a member that moves reciprocally in the scanning direction. The head 41 and the irradiator 50 may be mounted on the carriage 21, and the head 41 and the irradiator 50 can be moved reciprocally in the scanning direction as a result of the carriage 21 being moved reciprocally in the scanning direction. The carriage motor 22 may be a driver that moves the carriage 21 in the scanning direction. The carriage guide 24 may guide the carriage 21 in the scanning direction. The carriage guide 24 may include a rail extending in the scanning direction. The controller 60 may be configured or programmed to control the driving of the carriage motor 22 to control movement of the carriage 21.

The feeder 30 may feed the medium M. The medium M to be fed may be a long printing medium, such as rolled paper, or may be cut sheet. The medium M is not limited to paper and may be formed from a film or cloth, for example.

Figure 3A:
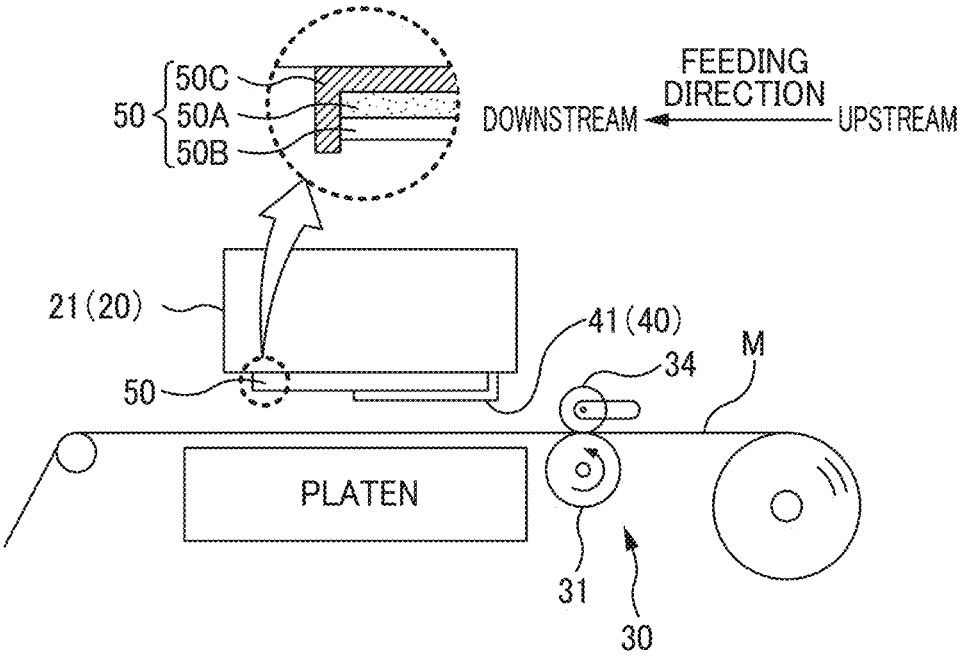
FIG. 3A is a schematic explanatory diagram of a feeder 30 and an irradiator 50.

FIG. 3A is a schematic explanatory diagram of the feeder (and the irradiator 50). The feeder 30 may include a feeding roller 31 and a feeding motor 32. The feeding roller 31 is a rotary roller to, for example, feed the medium M on a platen. The medium M can be fed in the feeding direction by rotating the feeding roller 31 while the medium M is being held between the feeding roller 31 and a pinch roller 34. The feeding motor 32 is a driver to, for example, rotate the feeding roller 31. The controller 60 may control the feeding of the medium M by controlling the drive of the feeding motor 32. Note that the feeder 30 is not limited to a configuration including the feeding roller 31. For example, a short medium M may be placed on a stand (flatbed) and the stand may be moved in the feeding direction to feed the medium M in the feeding direction.

The printer 40 is, for example, a printer to discharge ink droplets on the medium M. The printer 40 may include the head 41 and a head driver 42. The head 41 may include a plurality of nozzle rows 44 (see FIG. 3B) to discharge ink. The head driver 42 is, for example, a driver to allow and stop discharge of ink droplets from the nozzles of the head 41. If the head 41 is piezoelectric, for example, then the head driver 42 may be a driver to drive a piezoelectric element. The head 41 may be mounted on the carriage 21 and is capable of moving in the scanning direction together with the carriage 21. The controller 60 may control discharge of ink droplets from the head 41 by controlling the head driver 42.

Figure 3B:
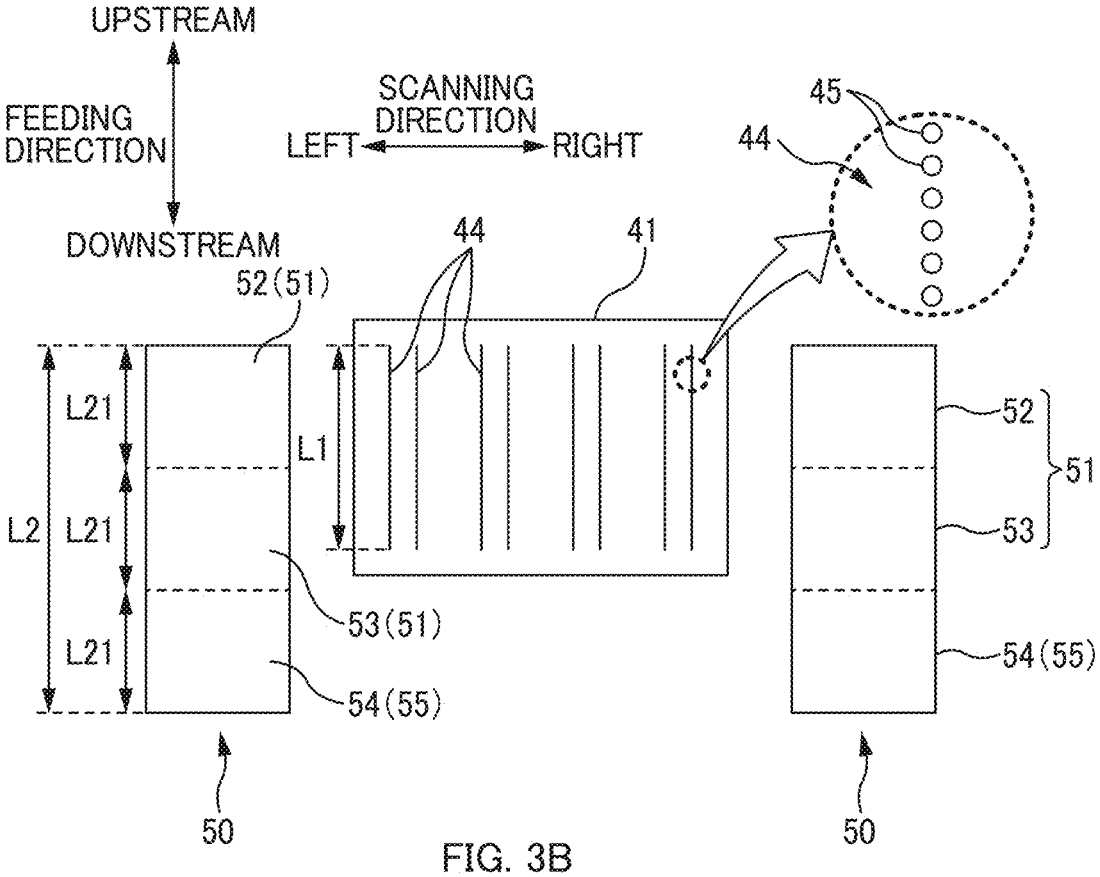
FIG. 3B is an explanatory diagram of disposition of a nozzle row 44 of a head 41 and the irradiator 50.

FIG. 3B is an explanatory diagram of the disposition of the nozzle row 44 of the head 41 and the irradiator 50.

The head 41 may include a plurality of the nozzle rows 44. The plurality of nozzle rows 44 may be disposed side by side in the scanning direction. Each of the nozzle rows 44 may include a plurality of nozzles 45 that are side by side in the feeding direction (see the enlarged diagram of the dotted region in FIG. 3B). In the description below, "L1" denotes the length of the nozzle row 44 in the scanning direction.

The head 41 may include a plurality of color ink nozzle rows to discharge color inks and a special ink nozzle row to discharge special ink. Color inks are inks used to print a color image on the medium M and may include, for example, a cyan ink, a magenta ink, a yellow ink, a black ink, and other such colored inks. The color ink nozzle rows may include, for example, a cyan ink nozzle row to discharge a cyan ink, a magenta ink nozzle row to discharge a magenta ink, a yellow ink nozzle row to discharge a yellow ink, and a black ink nozzle row to discharge a black ink. The special ink may include, for example, a transparent (including semi-transparent) ink such as clear ink, white ink, or silver ink. Clear ink, as an example of the special ink, may include gloss ink to control glossiness of an image or primer ink (ground adjustment ink) to adjust the ground of the medium M. The special ink nozzle row may include, for example, a gloss ink nozzle row or a primer ink nozzle row.

In this preferred embodiment, the ink discharged from the head 41 may be a photocurable ink. A photocurable ink is an ink which cures by being irradiated with light. The photocurable ink in this example is a UV curable ink (UV ink), but the photocurable ink may be an ink that cures by being irradiated with light having a different wavelength. The photocurable ink is fluid prior to being irradiated with light and has the property to cure as a result of being irradiated with light in a predetermined irradiation amount. When the photocurable ink is irradiated with light in an irradiation amount by which the ink does not cure completely, the ink assumes a state in which the surface of the ink is cured while the inside of the ink remains uncured. In the description below, the state prior to being completely cured (i.e. the state in which the surface of the ink is cured while the inside of the ink remains uncured) may be referred to as "semi-cured" or a "semi-cured state".

The irradiator 50 may, for example, radiate light to cure the photocurable ink. In this preferred embodiment, the irradiator 50 includes an LED lamp that radiates UV. Note, however, that the irradiator 50 may radiate light other than UV and may be configured from an element other than an LED lamp.

The irradiator 50 may be configured to be capable of radiating light onto a region that is longer than the nozzle rows 44 in the feeding direction. The irradiator 50 may include an LED array 50A, a lens array 50B, and a frame 50C (see FIG. 3A). The LED array 50A may include a plurality of LED lamps (light emission units) arrayed in the feeding direction. The lens array 50B may include lenses being arrayed in the feeding direction. Light radiated from the LED array 50A may be radiated onto the medium M via the lens array 50B. The frame 50C may be a body accommodating at least the LED array 50A and the lens array 50B. The frame 50C also functions to limit leakage of light outside a predetermined region (a region facing the irradiator 50). In the description below, "L2" denotes the length of the irradiator 50 in the feeding direction (i.e. the length of an irradiation region (will be described later) of the irradiator 50 in the feeding direction). The length L2 of the irradiator 50 may be greater than about 1.5 times and smaller than about 2.0 times the length L1 of the nozzle rows 44 and may specifically be set to about 1.7 to about 1.9 times the length L1 of the nozzle rows 44. A portion of the irradiator on an upstream side (an upstream-side irradiator 52 and an intermediate irradiator 53 to be described later) may be disposed so as to be side by side with the nozzle rows 44 in the scanning direction. A portion of the irradiator 50 on a downstream side (a downstream-side irradiator 54 to be described later) is disposed so as to protrude farther to the downstream side in the feeding direction than a downstream end of the nozzle rows 44. Note that the length of the irradiator 50 may not be the length of an opening of the lamp but, for example, the length of a range (irradiation area) that the lamp irradiates.

The irradiator 50 may be mounted on the carriage 21 and may be movable in the scanning direction together with the carriage (and the head 41). The irradiator 50 may be mounted on the carriage 21 in a pair, and the pair of irradiators 50 may be disposed to the left and right of the head 41, respectively, so as to have the head 41 interposed between the pair of irradiators 50 in the scanning direction. The controller 60 is capable of controlling lighting and extinguishing of the irradiator 50.

The controller 60 is, for example, a controller that is in charge of overall control of the printing apparatus 1. The controller 60 may control the drivers of the printing apparatus 1 (e.g., the carriage motor 22, the feeding motor 32, and the head driver 42) on the basis of the command code from the computer 70.

FIGS. 4A through 4F are explanatory diagrams illustrating manners in which dots are formed. As will be described later, in this preferred embodiment, dots are formed concurrently with light radiation from the irradiator 50; however, description will first focus solely on dot formation. In addition, although there are a plurality of nozzle rows 44 provided on the head 41, to simplify description, described below will be dot formation by a single nozzle row 44.

Figure 4A:
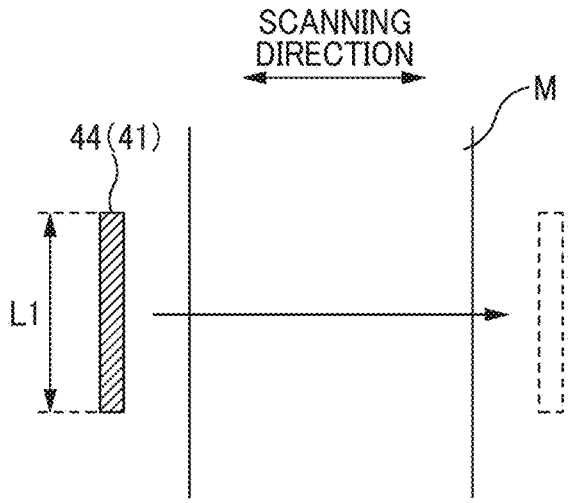
FIGS. 4A through 4F are explanatory diagrams illustrating manners in which dots are formed.
Figure 4B:
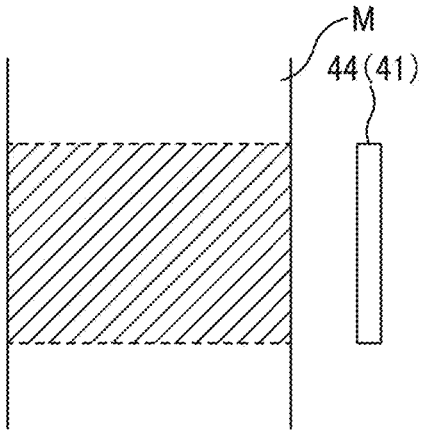

As illustrated in FIGS. 4A and 4B, the controller 60 may cause the carriage 21 to move in the scanning direction to move the head 41 (nozzle row 44) in the scanning direction while causing the nozzles to discharge ink, thus forming dots on the medium M. In the description below, an operation to cause the carriage 21 to move in the scanning direction may be referred to as a "pass". FIG. 4B illustrates, in hatched fashion, a region (printing region) on which dots can be formed in a single pass. The printing region is a region which the nozzle row 44 faces while the carriage 21 is moving in the scanning direction so as to transverse the medium M.

Figure 4C:
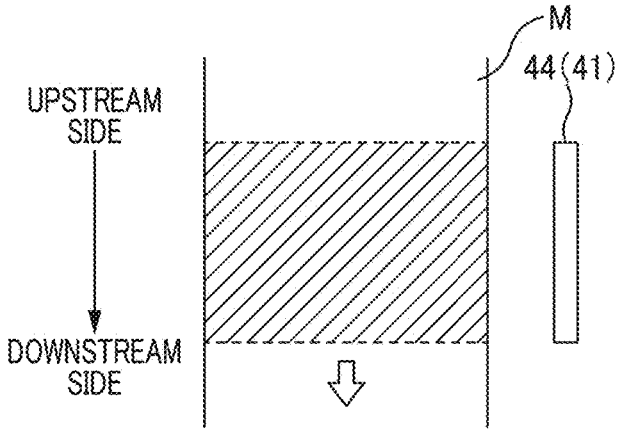
Figure 4D:
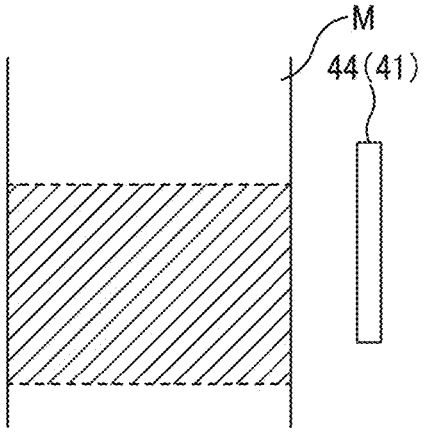

After causing the carriage 21 to move in the scanning direction (after formation of dots), the controller 60 may cause the medium M to be fed in the feeding direction, as illustrated in FIGS. 4C and 4D. This operation may be referred to as "feeding operation" in the description below. According to the feeding operation, the downstream side of the printing region of the immediately preceding pass may be discharged outside a printing region of the next pass (see FIGS. 4E and 4F) and an unprinted region of the medium M may be supplied to the upstream side of the next printing region.

Figure 4E:
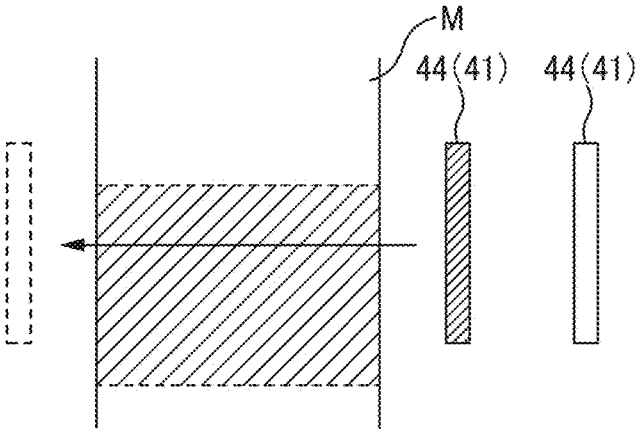
Figure 4F:
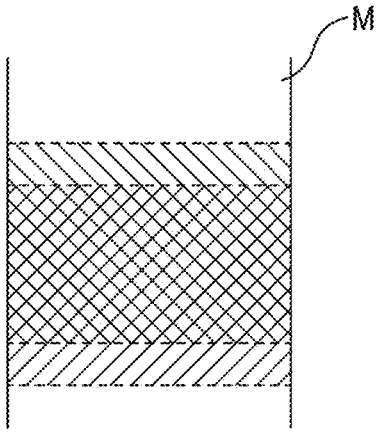

Following the feeding operation, the controller 60 may carry out the next pass, as illustrated in FIGS. 4E and 4F. In this way, the controller 60 may form dots on the medium M by repeating the pass and the feeding operation alternately. If a feeding length (feeding amount) at the time of the feeding operation is smaller than the length of a printing region in the feeding direction, then, as illustrated in FIG. 4F, a current printing region overlaps with a portion of the printing region of the preceding pass (see FIG. 4B).

Figure 5A:
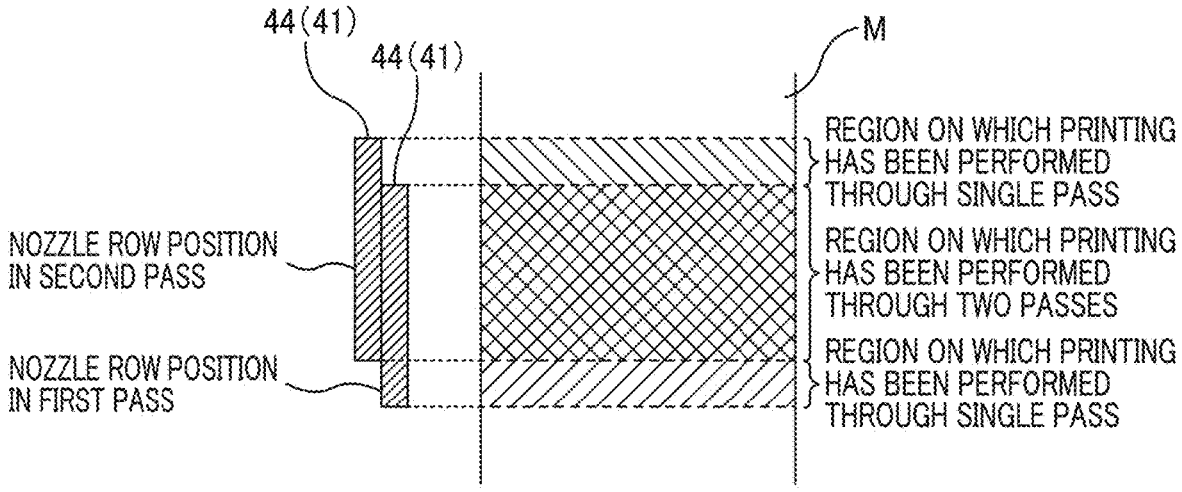
FIG. 5A is an explanatory diagram illustrating the dot formation manners illustrated in FIGS. 4A through 4F in a different way.

FIG. 5A is an explanatory diagram illustrating the dot formation manners illustrated in FIGS. 4A through 4F in a different way. FIG. 5A illustrates positions (relative positions) of the nozzle rows 44 in each of the passes relative to the medium M. As has already been described, the head 41 moves in the scanning direction and does not move in the feeding direction, but as illustrated in FIG. 5A, it is possible to illustrate the manner in which dots are formed in the passes by varying the position of the nozzle row 44 relative to the medium M.

Figure 5B:
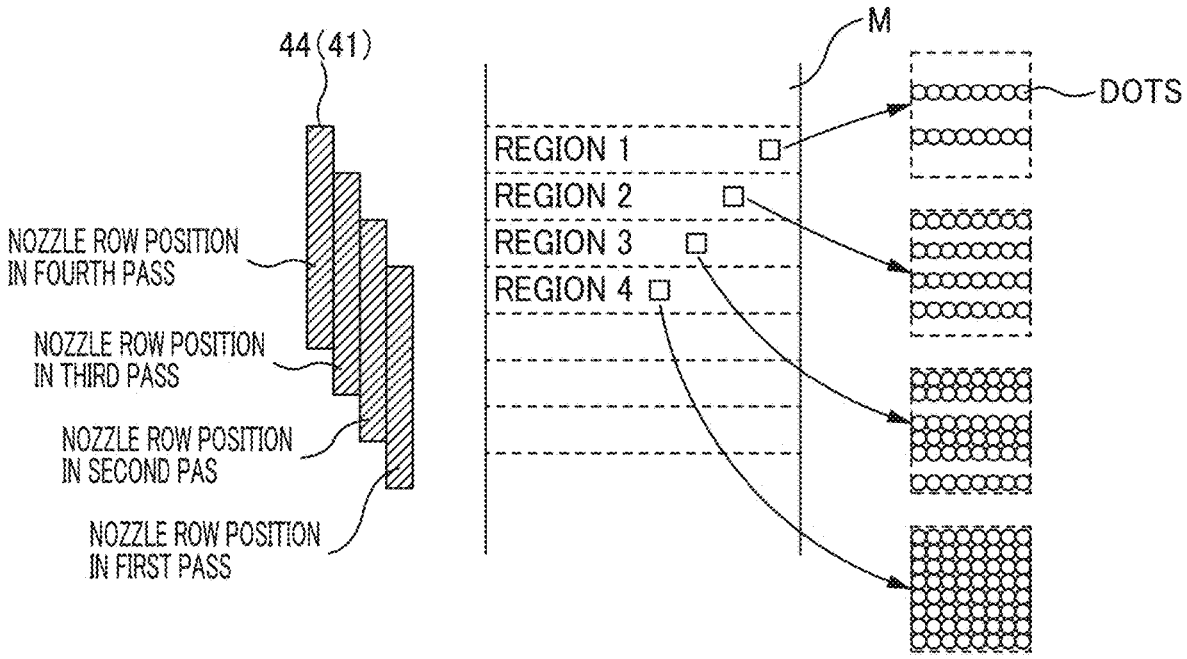
FIG. 5B is an explanatory diagram of multi-pass printing.

FIG. 5B is an explanatory diagram of the multi-pass printing. Multi-pass printing is printing in which a pass is performed a plurality of times on regions of the medium M. FIG. 5B illustrates a manner in which four-pass printing is performed, where four passes are performed on regions of the medium M.

"Region 1" in FIG. 5B is a region on which printing has been performed through a single pass (fourth pass). In the case of four-pass printing, about ¼ of dots may be formed in the region 1. "Region 2" in FIG. 5B may be a region on which printing has been performed through two passes (third and fourth passes). In the case of four-pass printing, about half the dots may be formed in the region 2. "Region 3" in FIG. 5B may be a region on which printing has been performed through three passes (second through fourth passes). In the case of four-pass printing, about ¾ of the dots may be formed in the region 3. "Region 4" in FIG. 5B may be a region on which printing has been performed through four passes (first through fourth passes). In the "region 4", the dots formed in the passes (first through fourth passes) may be disposed so as to be distributed in the feeding direction. In this way, it is a characteristic of multi-pass printing that dots formed over a plurality of passes can be distributed in the feeding direction. In the case of four-pass printing, all of the dots that are to be formed are formed in the region 4. In the case of four-pass printing, the feeding length (feeding amount) at the time of the feeding operation may be about ¼ of the length of the printing region in the feeding direction. Thus, when ink is discharged from all nozzles of the nozzle row 44, then in the case of four-pass printing, the feeding length (feeding amount) at the time of the feeding operation may be about ¼ of the length L1 of the nozzle row 44.

Figure 6:
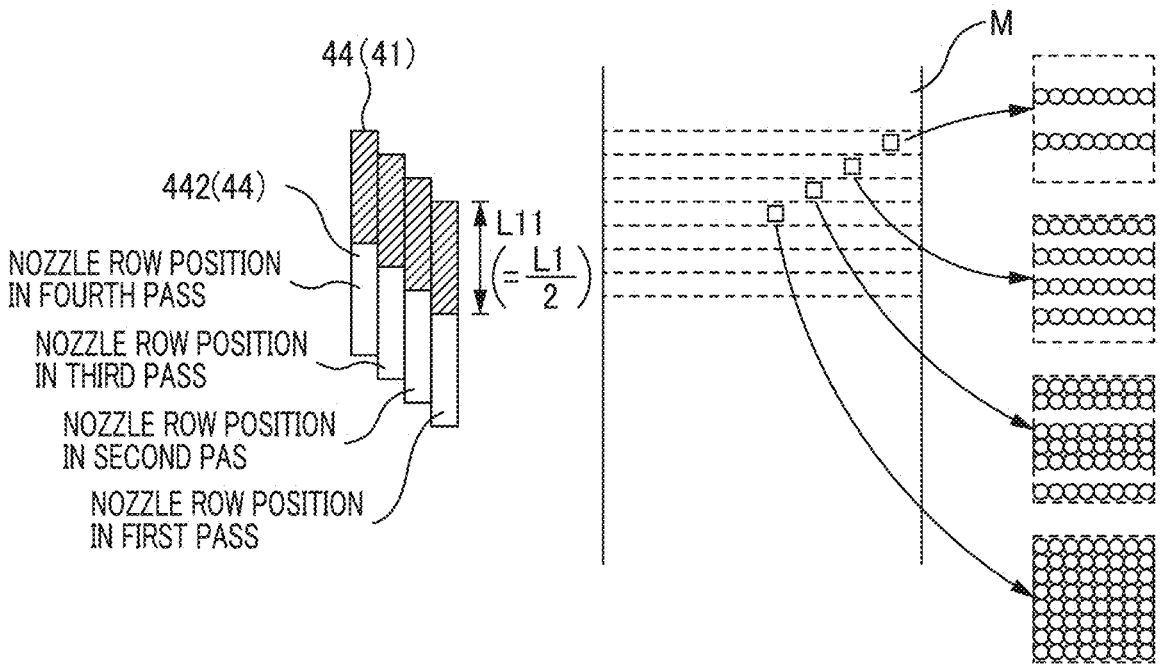
FIG. 6 is an explanatory diagram illustrating a case where four-pass printing using half the nozzle row 44 is carried out.

FIG. 6 is an explanatory diagram illustrating a case where four-pass printing using half the nozzle row 44 is carried out. In the drawing, the portion of the nozzle row 44 from which ink is discharged is hatched. Nozzles in the portion that is not hatched are not used, and these nozzles do not discharge ink.

In this preferred embodiment, each nozzle row 44 may be divided into two nozzle rows, i.e. an upstream-side nozzle row 441 and a downstream-side nozzle row 442, and the controller 60 is capable of controlling ink discharge for each of the upstream-side nozzle row 441 and the downstream-side nozzle row 442 obtained through this two-piece division. The upstream-side nozzle row 441 is the nozzle row on the upstream side in the feeding direction within the nozzle row 44 having been divided in two. The downstream-side nozzle row 442 is the nozzle row on the downstream side in the feeding direction within the nozzle row 44 having been divided in two, and is the nozzle row that is located on the downstream side from the upstream-side nozzle row 441 in the feeding direction. The upstream-side nozzle row 441 and the downstream-side nozzle row 442 are adjacent to each other, so there is no other nozzle row interposed between the upstream-side nozzle row 441 and the downstream-side nozzle row 442.

The nozzle row 44 may be divided more or less evenly into the upstream-side nozzle row 441 and the downstream-side nozzle row 442. For example, if the nozzle row 44 includes 180 nozzles, the upstream-side nozzle row 441 includes the 90 nozzles on the upstream side. For example, if the nozzle row 44 includes 180 nozzles, the downstream-side nozzle row 442 includes the 90 nozzles on the downstream side. In the description below, "L11" denotes the length of the upstream-side nozzle row 441 in the feeding direction (or the length of the downstream-side nozzle row 442 in the feeding direction).

As illustrated in FIG. 6, also when four-pass printing is carried out using half the nozzle row 44, the feeding length (feeding amount) at the time of the feeding operation may be about ¼ of the length of the printing region in the feeding direction. However, the length of the nozzle row 44 is virtually halved, so if ink is discharged from half the nozzles in the nozzle row 44, then in the case of four-pass printing, the feeding length (feeding amount) at the time of the feeding operation may be about ⅛ of the length L1 of the nozzle row 44. That is, when half the nozzle row 44 is used to carry out four-pass printing, the feeding length (feeding amount) at the time of the feeding operation may be about ½ compared to when ink is discharged from all nozzles of the nozzle row 44.

Figure 7A:
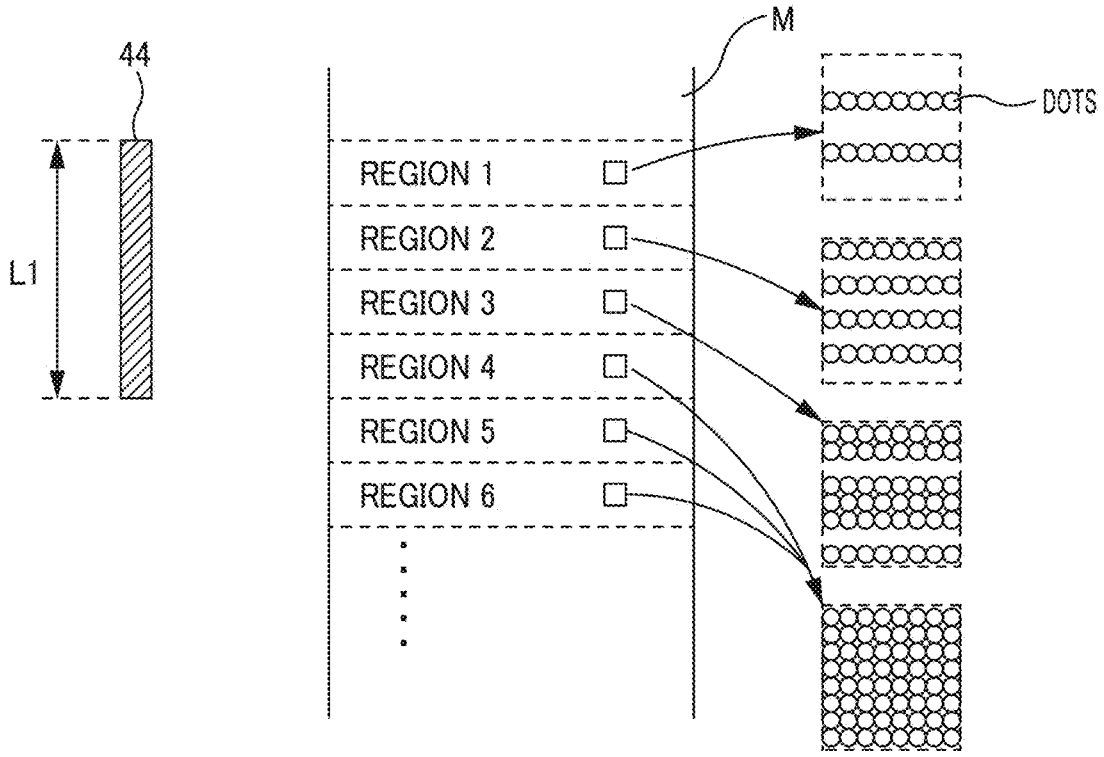
FIG. 7A is an explanatory diagram illustrating a manner in which dots are formed in an n-th (n>4) pass when four-pass printing is carried out using all nozzles.
Figure 7B:
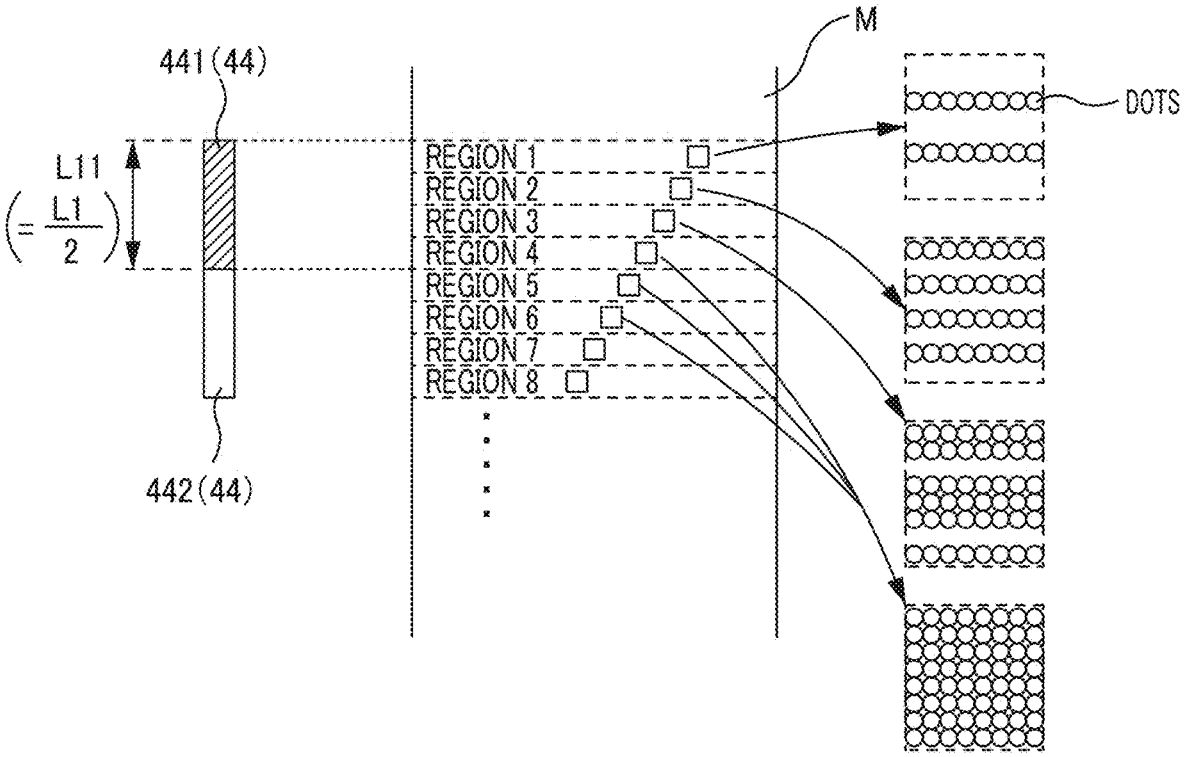
FIG. 7B is an explanatory diagram illustrating a manner in which dots are formed in an n-th (n>4) pass when four-pass printing is carried out using half the nozzle row 44.

FIG. 7A is an explanatory diagram illustrating a manner in which dots are formed in an n-th (n>4) pass when four-pass printing is carried out using all nozzles. FIG. 7B is an explanatory diagram illustrating a manner in which dots are formed in an n-th (n>4) pass when four-pass printing is carried out using half the nozzle row 44. As illustrated in the drawings, a printing region in which printing is carried out through passes from the fourth pass onward may be divided into four regions, i.e. "region 1", "region 2", "region 3", and "region 4" from the upstream side in the feeding direction. In this case as well, the "region 1" may be a region on which printing has been carried out through a single pass, and about ¼ of the dots may be formed in the region. Likewise, the "region 2" may be a region on which printing has been performed through two passes and about half the dots may be formed in the region. The "region 3" may be a region on which printing has been performed through three passes and about ¾ of the dots are formed in the region. The "region 4" may be a region on which printing has been performed through four passes and all of the dots that are to be formed are formed in the region. Each of regions from a region 5 onward on the downstream side from the region 4 in the feeding direction is, similarly to the "region 4", a region on which printing has been performed through four passes and all dots that are to be formed are formed in the region. The length (width) of each region in the feeding direction corresponds to the feeding length (feeding amount) at the time of the feeding operation. In the description below, there may be cases where, the multi-pass printing as illustrated in FIG. 5B or FIG. 6 is meant by simply showing the dots formation of a certain pass as illustrated in FIGS. 7A and 7B.

As illustrated in FIG. 3B, in this preferred embodiment, the irradiator 50 may be divided in three into the upstream-side irradiator 52, the intermediate irradiator 53, and the downstream-side irradiator 54, and the controller 60 is capable of controlling lighting and extinguishing of each of the upstream-side irradiator 52, the intermediate irradiator 53, and the downstream-side irradiator 54.

The upstream-side irradiator 52 is the irradiator on the upstream side in the feeding direction within the irradiator 50 having been divided in three. The upstream-side irradiator 52 may be disposed side by side with the upstream-side nozzle row 441 in the scanning direction. The upstream-side irradiator 52 may overlap a range of the upstream-side nozzle row 441 in the feeding direction. Thus, the upstream-side irradiator 52 is capable of radiating light onto dots immediately after being formed by the upstream-side nozzle row 441 (i.e. is capable of radiating light onto the printing region of the upstream-side nozzle row 441).

Within the irradiator 50 having been divided in three, the intermediate irradiator 53 is the irradiator that is adjacent to the upstream-side irradiator 52 on the downstream side in the feeding direction. The intermediate irradiator 53 may be disposed so as to be side by side with the downstream-side nozzle row 442 in the scanning direction. The intermediate irradiator 53 may overlap a range of the downstream-side nozzle row 442 in the feeding direction, and is capable of radiating light onto dots immediately after being formed by the downstream-side nozzle row 442. The intermediate irradiator 53 is adjacent to the upstream-side irradiator 52, so there is no other irradiator interposed between the upstream-side irradiator 52 and the intermediate irradiator 53.

The upstream-side irradiator 52 and the intermediate irradiator 53 may be collectively referred to as a "printing region irradiator 51". The printing region irradiator 51 is the irradiator on the upstream side in the feeding direction within the irradiator 50. The printing region irradiator 51 may be disposed side by side with the nozzle row 44 in the scanning direction. The printing region irradiator 51 may overlap a range of the nozzle row 44 in the feeding direction. Thus, the printing region irradiator 51 is capable of radiating light onto dots immediately after being formed by the nozzle row 44.

Within the irradiator 50 having been divided in three, the downstream-side irradiator 54 is the irradiator that is adjacent of the intermediate irradiator 53 on the downstream side in the feeding direction. The downstream-side irradiator 54 does not overlap the range of the downstream-side nozzle row 442 in the feeding direction, and is disposed farther on the downstream side in the feeding direction than the downstream-side nozzle row 442. The downstream-side irradiator 54 is adjacent to the intermediate irradiator 53, so there is no other irradiator interposed between the downstream-side irradiator 54 and the intermediate irradiator 53. The downstream-side irradiator 54 may be called a "printless region irradiator 55".

The irradiator 50 may be divided more or less evenly into the upstream-side irradiator 52, the intermediate irradiator 53, and the downstream-side irradiator 54. In the description below, "L21" denotes the length of the upstream-side irradiator 52 (or the intermediate irradiator 53 or the downstream-side irradiator 54) in the feeding direction. In this preferred embodiment, the length L21 of the upstream-side irradiator 52 may be slightly greater than the length L11 of the upstream-side nozzle row 441 (which is half the length L of the nozzle row 44) (L21>L11).

Figure 8:
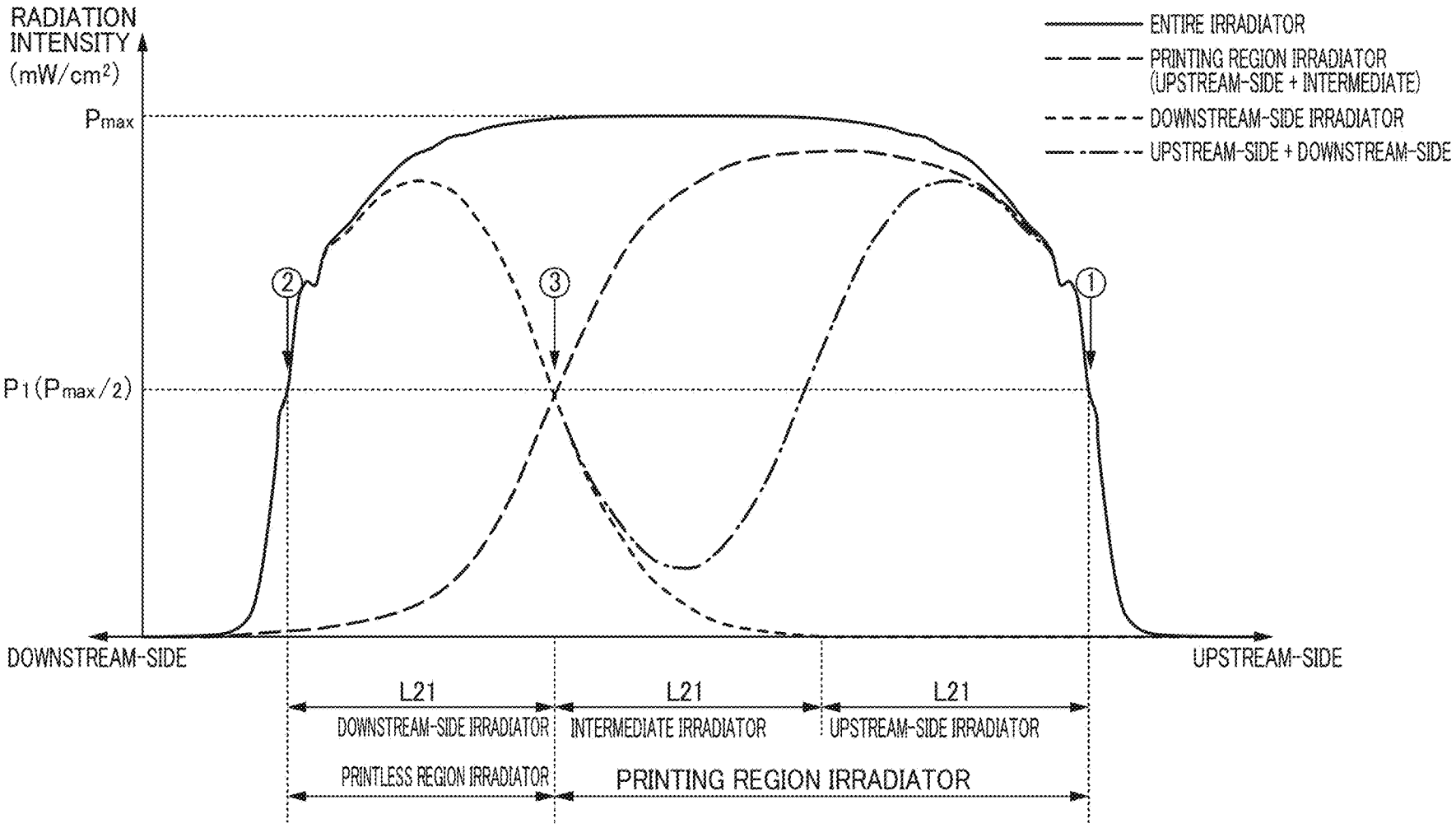
FIG. 8 is a graph of radiation intensity of the irradiator 50.

FIG. 8 is a graph of radiation intensity of the irradiator 50. The horizontal axis in the graph indicates a position in the feeding direction. The vertical axis in the graph indicates light radiation intensity per unit area (unit: $mW/cm^2$).

When light is radiated from the entire region of the irradiator 50, radiation intensity reaches a maximum Pmax in the central portion of the irradiator 50, as indicated by the solid line graph. In the drawing, "P1" denotes half of maximum Pmax. In this example, half width is set to correspond to the length of the irradiator 50 in the feeding direction. The position (the position of the circled 1 in the graph) on the upstream side in the feeding direction where radiation intensity is P1 corresponds to the position of the upstream end of the upstream-side irradiator 52. The position (the position of the circled 2 in the graph) on the downstream side in the feeding direction where radiation intensity is P1 corresponds to the position of the downstream end of the downstream-side irradiator 54. P1 has radiation intensity by which photocurable ink is able to be brought to a cured state (including a semi-cured state). Accordingly, when light is radiated from the entire region of the irradiator 50, the region facing the irradiator 50 is irradiated with light with which photocurable ink is able to be cured (or semi-cured).

The irradiation region of the irradiator 50 may mean, in a narrow sense, a region in which a predetermined radiation intensity (P1 in this example) or higher is achieved when light is radiated, so in this example, the region is a region that faces the irradiator; however, in a broad sense, the region may mean a region that is irradiated with light when light is radiated.

When light is radiated from the entire region of the irradiator 50, change in radiation intensity (the slopes at the positions of the circled 1 and 2 in the graph) at the position where radiation intensity is P1 is relatively steep. The reason therefor is that, as illustrated in FIG. 3A, the frame 50C of the irradiator 50 is limiting leakage of light outside the irradiation region (region facing the irradiator 50). Accordingly, a region in which light leaks outside the irradiation region (region facing the irradiator 50) is extremely small.

When the downstream-side irradiator 54 is extinguished while the printing region irradiator 51 (the upstream-side irradiator 52 and the intermediate irradiator 53) is being lit, the position (the position of the circled 1 in the graph) on the upstream side in the feeding direction where radiation intensity is P1 corresponds to the position of the upstream end of the upstream-side irradiator 52. The change in radiation intensity at this position (the slope at the position of the circled 1 in the graph) is relatively steep. Thus, a region where light leaks farther on the upstream side than the upstream-side irradiator 52 is extremely small. The position (the position of the circled 3 in the graph) on the downstream side in the feeding direction where radiation intensity is P1 may correspond to the position of the downstream end of the intermediate irradiator 53 and may correspond to the position of a boundary portion between the intermediate irradiator 53 and the downstream-side irradiator 54. The change in radiation intensity at this position (the slope at the position of the circled 3 in the graph) is relatively mild. The reason therefor is that since there is no member that blocks light, as does the frame 50C, at the boundary portion between the intermediate irradiator 53 and the downstream-side irradiator 54, light radiated from the intermediate irradiator 53 leaks farther to the downstream side in the feeding direction than the intermediate irradiator 53 (the region facing the downstream-side irradiator 54). Thus, a region onto which light is radiated farther on the downstream side than the intermediate irradiator 53 is a relatively great region (a region that is greater than the region where light leaks farther to the upstream side than the upstream-side irradiator 52).

When the printing region irradiator 51 (the upstream-side irradiator 52 and the intermediate irradiator 53) is extinguished while the printless region irradiator 55 (the downstream-side irradiator 54) is being lit, the position (the position of the circled 2 in the graph) on the downstream side in the feeding direction where radiation intensity is P1 corresponds to the position of the downstream end of the downstream-side irradiator 54. The change in radiation intensity at this position (the slope at the position of the circled 2 in the graph) is relatively steep. Thus, a region where light leaks farther on the downstream side than the downstream-side irradiator 54 is extremely small. The position (the position of the circled 3 in the graph) on the upstream side in the feeding direction at which radiation intensity is P1 may correspond to the position of the upstream end of the downstream-side irradiator 54, and corresponds to the position of the boundary portion between the intermediate irradiator 53 and the downstream-side irradiator 54. The change in radiation intensity at this position (the slope at the position of the circled 3 in the graph) is relatively mild. The reason therefor is that since there is no member that blocks light, as does the frame 50C, at the boundary portion between the intermediate irradiator 53 and the downstream-side irradiator 54, light radiated from the downstream-side irradiator 54 leaks farther to the upstream side in the feeding direction than the downstream-side irradiator 54 (the region facing the intermediate irradiator 53). Thus, a region onto which light is radiated farther on the upstream side than the downstream-side irradiator 54 is a relatively great region (a region that is greater than the region where light leaks farther to the downstream side than the downstream-side irradiator 54).

When the intermediate irradiator 53 is extinguished while the upstream-side irradiator 52 and the downstream-side irradiator 54 are being lit, radiation intensity is smaller than P1 in the central portion of the irradiator 50. In this example, radiation intensity is set to be smaller than P1 in the region facing the intermediate irradiator 53. Radiation intensity is P1 at the positions of the upstream end and the downstream end of the intermediate irradiator 53. The change in radiation intensity at the positions of the upstream end and the downstream end of the intermediate irradiator 53 is relatively mild. The reason therefor is that light leaks from the upstream-side irradiator 52 and light also leaks from the downstream-side irradiator 54.

Figure 9:
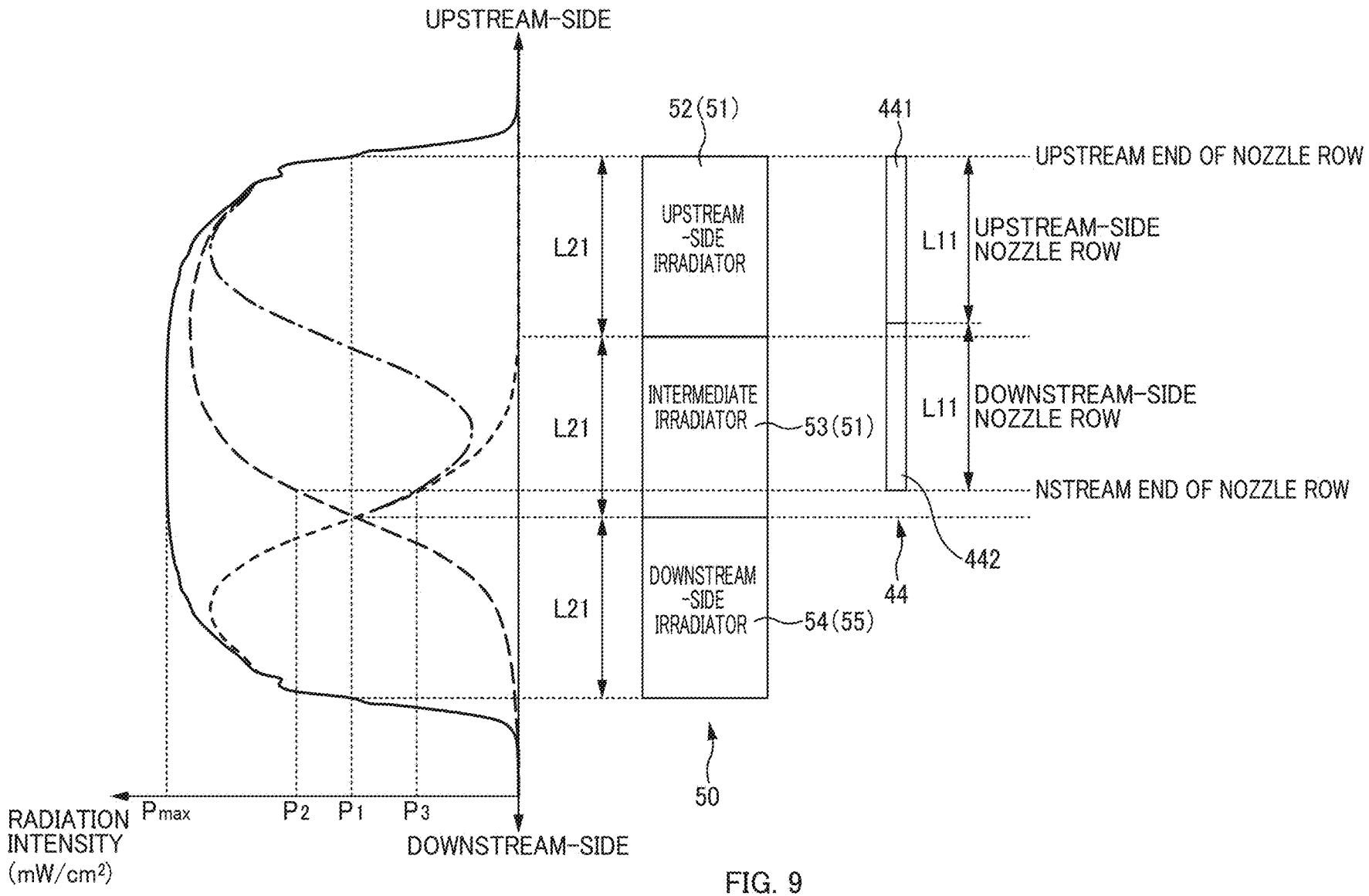
FIG. 9 is a diagram illustrating a positional relationship between the nozzle row 44 and the irradiator 50.

FIG. 9 is a diagram illustrating a positional relationship between the nozzle row 44 and the irradiator 50. The position of the nozzle row 44 (the positions of the upstream-side nozzle row 441 and the downstream-side nozzle row 442) is (are) indicated on the right-hand side in the drawing. The position of the irradiator 50 (the positions of the upstream-side irradiator 52, the intermediate irradiator 53, and the downstream-side irradiator 54) is (are) indicated in the central portion in the drawing. A graph of the radiation intensity of the irradiator 50 is illustrated on the left-hand side in the drawing. This graph is equivalent to that illustrated in FIG. 8.

The position of the upstream end of the nozzle row 44 (the most upstream nozzle from among the plurality of nozzles forming the nozzle row 44) may be set at the position of the upstream end of the irradiator 50. Accordingly, the radiation intensity of the irradiator 50 at the position of the upstream end of the nozzle row 44 may be set to be P1 (half the maximum Pmax).

The nozzle row 44 (the upstream-side nozzle row 441 and the downstream-side nozzle row 442) may be disposed so as to be side by side with the printing region irradiator 51 (the upstream-side irradiator 52 and the downstream-side irradiator 54) in the scanning direction. The length of the printing region irradiator 51 (double the L21) may be greater than the length L1 of the nozzle row 44, and accordingly, the printing region irradiator 51 may be disposed so as to encompass a range of the nozzle row 44 in the feeding direction. When the printing region irradiator 51 is lit, a region on which printing is carried out by the nozzle row 44 is irradiated with light having a higher radiation intensity than P1. In other words, when the printing region irradiator 51 is lit, the region on which printing is carried out by the nozzle row 44 is irradiated with light with which photocurable ink is able to be cured.

The upstream-side nozzle row 441 may be disposed so as to be side by side with the upstream-side irradiator 52 in the scanning direction. The length L21 of the upstream-side irradiator 52 may be slightly greater than the length L11 of the upstream-side nozzle row 441, and accordingly, the upstream-side irradiator 52 may be disposed so as to encompass a range of the upstream-side nozzle row 441 in the feeding direction. When the upstream-side irradiator 52 is lit, the region on which printing is carried out by the upstream-side nozzle row 441 is irradiated with light with which photocurable ink is able to be cured (light having a higher radiation intensity than P1).

The downstream-side nozzle row 442 may be disposed so as to be side by side with the intermediate irradiator 53 in the scanning direction. The position of the upstream end of the downstream-side nozzle row 442 (the most upstream nozzle from among the plurality of nozzles forming the downstream-side nozzle row 442) may be set to be slightly to the upstream side from the position of the upstream end of the intermediate irradiator 53. Meanwhile, the intermediate irradiator 53 may encompass most of the range of the downstream-side nozzle row 442 in the feeding direction. When the upstream-side irradiator 52 is lit and the intermediate irradiator 53 is extinguished, radiation intensity is P1 or lower in most of the region on which printing is carried out by the downstream-side nozzle row 442.

In this preferred embodiment, the position of the downstream end of the nozzle row 44 (the most downstream nozzle from among the plurality of nozzles forming the nozzle row 44) may be set to be farther on the upstream side in the feeding direction than the boundary portion between the intermediate irradiator 53 and the downstream-side irradiator 54. In other words, at least a portion of the printing region irradiator 51 on the downstream side in the feeding direction (i.e., at least a portion of the intermediate irradiator 53 on the downstream side in the feeding direction) may be disposed farther on the downstream side in the feeding direction than the downstream end of the nozzle row 44. Moreover, the downstream-side irradiator 54 may be disposed on the downstream side in the feeding direction, and at an interval, from the downstream end of the nozzle row 44. Accordingly, when the downstream-side irradiator 54 is extinguished while the printing region irradiator 51 is being lit, radiation intensity P2 (see the graph on the left-hand side in FIG. 9) at the position of the downstream end of the nozzle row 44 is a value exceeding P1 (half the maximum Pmax). Further, when the downstream-side irradiator is lit while the printing region irradiator 51 is being extinguished, radiation intensity P3 at the position of the downstream end of the nozzle row 44 is a value smaller than P1 (half the maximum Pmax). In this way, in this preferred embodiment, the radiation intensity P3 at the downstream end of the nozzle row 44 when the downstream-side irradiator 54 is lit while the printing region irradiator 51 is being extinguished is smaller than the radiation intensity P2 at the same position when the downstream-side irradiator 54 is extinguished while the printing region irradiator 51 is being lit.

FIG. 10A is an explanatory diagram illustrating a manner in which dots are formed in color printing mode. Here, illustrated is a manner in which four-pass printing is performed. While the drawing only illustrates a single color ink nozzle row, the other color ink nozzle rows discharge color ink equivalently to this color ink nozzle row.

In color printing mode, the controller 60 may cause all nozzles of the color ink nozzle row to discharge color ink while having the printing region irradiator 51 (the upstream-side irradiator 52 and the intermediate irradiator 53) lit in each pass. Note that in color printing mode, smoothening is not required and dots may be cured, so the printless region irradiator 55 (the downstream-side irradiator 54) may be lit. The controller 60 may cause such a pass and the feeding operation to be performed alternately. In the "region 1" through the "region 4", color dots may be formed with color inks on the medium M, and the color dots immediately after formation may be irradiated with light by the printing region irradiator 51 and be cured (or semi-cured). In the "region 2" through the "region 4", color dots may be additionally formed in the region in which color dots were formed in the immediately preceding pass. Here, the color dots that were formed in the immediately preceding pass have been cured by being irradiated with light immediately after formation, so a condition can be achieved in which when color dots are formed additionally in the "region 2" through the "region 4", the color dots do not bleed easily.

In the color printing mode of this preferred embodiment, the controller 60 may light not only the printing region irradiator 51 but also the printless region irradiator 55 (the downstream-side irradiator 54). Accordingly, the color dots cured in the "region 4" are able to be additionally cured in and after the "region 5" with light radiated from the printless region irradiator 55. If the energy of light radiated onto the color dots is sufficient, however, the controller 60 may extinguish the printless region irradiator 55 during the color printing mode.

Even if the printless region irradiator 55 (the downstream-side irradiator 54) were extinguished, in this preferred embodiment, at least a portion of the printing region irradiator 51 on the downstream side in the feeding direction may be disposed farther on the downstream side in the feeding direction than the lower end of the nozzle row 44, so the radiation intensity P2 (see the graph on the left-hand side in FIG. 9) at the position of the lower end of the nozzle row 44 may be a value exceeding P1 (half the maximum Pmax); thus the "region 4" too may be irradiated with light having a relatively high intensity and the color dots can be cured.

Furthermore, even if the printless region irradiator 55 (downstream-side irradiator 54) were extinguished, in this preferred embodiment, there is no member that blocks light, as does the frame 50C, at the boundary portion between the intermediate irradiator 53 and the downstream-side irradiator 54, so light radiated from the intermediate irradiator 53 may leak to the downstream side than the intermediate irradiator 53 in the feeding direction. Accordingly, after all of the color dots to be formed have been formed, regions (for example, "region 5") that are farther on the downstream side in the feeding direction than the "region 4" are irradiated with light from the intermediate irradiator 53 so that the color dots can be additionally cured.

FIG. 10B is an explanatory diagram illustrating a manner in which dots are formed in gloss printing mode.

In gloss printing mode, the controller 60 may cause all nozzles of the gloss ink nozzle row to discharge gloss ink and light the printless region irradiator 55 (the downstream-side irradiator 54) while having the printing region irradiator 51 extinguished in each pass. The controller 60 may cause such a pass and the feeding operation to be performed alternately. In the "region 1" through the "region 4", gloss dots may be formed with gloss ink on the medium M. In the gloss printing mode, for example, the printing region irradiator 51 is extinguished, so almost no light is radiated onto the gloss dots immediately after formation and the gloss dots immediately after formation are not cured. Accordingly, the gloss dots may wet and spread over the medium M gradually and be smoothened. In the "region 2" through the "region 4", gloss dots may be additionally formed in the region in which gloss dots were formed in the immediately preceding pass. The gloss dots formed in the immediately preceding pass are uncured, so when gloss dots are formed additionally in the "region 2" through the "region 4", the dots and the uncured gloss ink dots are mixed and bond to one another. When adjacent dots bond to each other, the surface is smoothened. Accordingly, when all of the gloss dots that are to be formed in the "region 4" have been formed, a film (glossy film or glossy layer) of gloss ink with a smooth surface is formed. Then, the film of gloss ink with a smooth surface may be irradiated with light from the printless region irradiator 55 (the downstream-side irradiator 54) in regions (for example, the "region 5") farther on the downstream side than the "region 4" in the feeding direction, and thus be cured. Accordingly, a glossy layer with a smooth surface is able to be formed on the medium M.

In this preferred embodiment, at least a portion of the printing region irradiator 51 on the downstream side in the feeding direction may be disposed farther on the downstream side in the feeding direction than the downstream end of the nozzle row 44, and the printless region irradiator 55 (the downstream-side irradiator 54) may be disposed farther on the downstream side in the feeding direction than the downstream end of the nozzle row 44. Accordingly, radiation intensity P3 (see the graph on the left-hand side in FIG. 9) at the position of the lower end of the nozzle row 44 is a value smaller than P1 (half the maximum Pmax), and thus light radiated onto the "region 4 (and the region 3)" (light leaking from the downstream-side irradiator 54 defining the printless region irradiator 55) is relatively weak. Accordingly, a condition is achieved in which the gloss dots formed in the "region 4" do not cure easily. Accordingly, the gloss dots formed in the "region 4" wet, spread, and are smoothened more easily so that a film (glossy layer) of gloss ink with a smooth surface is able to be formed stably.

Light leaking to the upstream side from the printless region irradiator 55 (the downstream-side irradiator 54) may be radiated onto the printing region (the "region 3" and the "region 4") of the downstream-side nozzle row 442 (see FIG. 9). Accordingly, the gloss dots formed in the "region 1" through the "region 3" are irradiated with the leakage light from the printless region irradiator 55 twice in the "region 3" and the "region 4". Meanwhile, the gloss dots formed in the "region 4" are irradiated with the leakage light from the printless region irradiator 55 once in the "region 4". In other words, the gloss dots formed in the "region 1" through the "region 3" and the gloss dots formed in the "region 4" differ in the number of times of irradiation with the leakage light from the printless region irradiator 55. If there were an increase in the difference in gloss dot curing degree due to the difference in the number of times of irradiation, then stripes might unintendedly be formed in the film of gloss ink. In this preferred embodiment, however, since the radiation intensity of light radiated from the printless region irradiator 55 onto the printing region (the "region 3" and the "region 4") of the downstream-side nozzle row 442 is low, as illustrated in FIGS. 8 and 9, the difference in gloss dot curing degree due to the difference in the number of times of irradiation is small. Furthermore, in this preferred embodiment, as illustrated in FIGS. 8 and 9, the change in radiation intensity in the printing region of the downstream-side nozzle row 442 (the "region 3" and the "region 4") is relatively mild and, in this preferred embodiment, gloss dots irradiated different numbers of times are distributed through multi-pass printing, so the difference in gloss dot curing degree is not conspicuous. For such reasons, in this preferred embodiment, even if light leaking to the upstream side from the downstream-side irradiator 54 defining the printless region irradiator 55 is radiated on the printing region (the "region 3" and the "region 4") of the downstream-side nozzle row 442, formation of stripes in the film of gloss ink is able to be limited.

In this preferred embodiment, mixed printing mode is able to be achieved in which printing is carried out by mixing dots cured immediately after formation and dots cured after being smoothened. The mixed printing mode may encompass, for example, glossy color printing mode, smooth color printing mode, and primer printing mode. In all of such mixed printing modes, the controller 60 may cause the upstream-side nozzle row 441 and the downstream-side nozzle row 442 to discharge ink while having the upstream-side irradiator 52 lit, the intermediate irradiator 53 extinguished, and the downstream-side irradiator 54 lit in each pass. The controller 60 may cause such a pass and the feeding operation to be performed alternately. The various printing modes will be described below.

Figure 11:
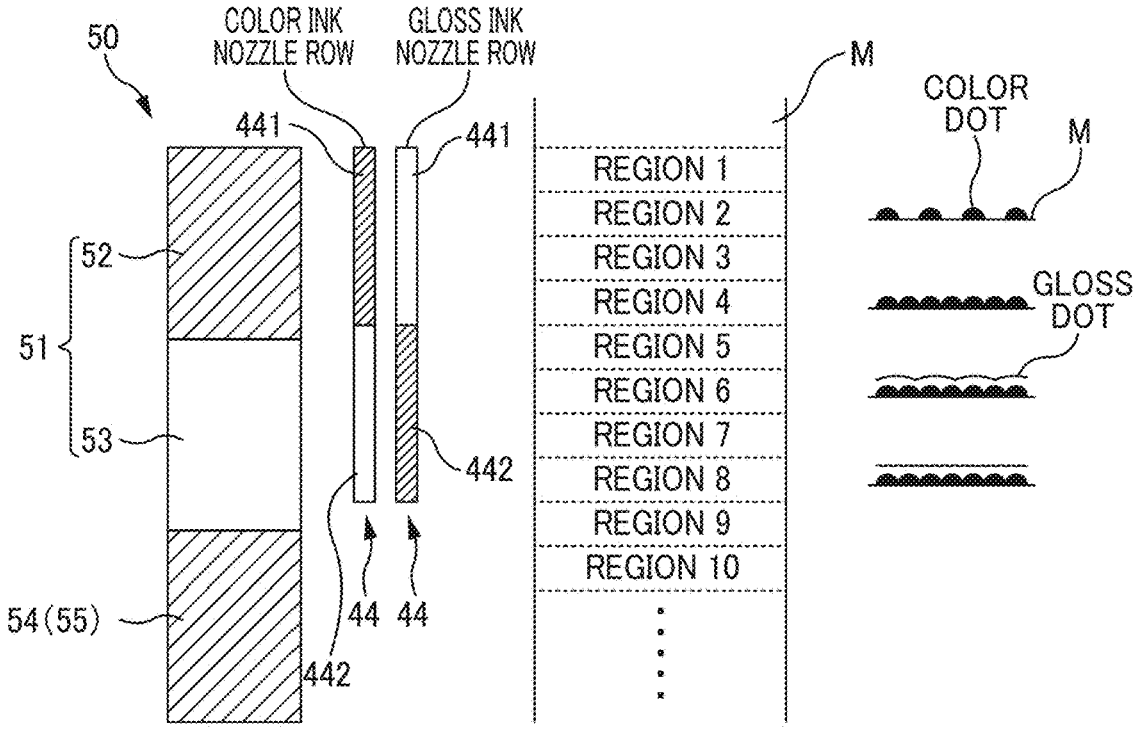
FIG. 11 is an explanatory diagram illustrating a manner in which dots are formed in glossy color printing mode.

FIG. 11 is an explanatory diagram illustrating a manner in which dots are formed in glossy color printing mode. The glossy color printing mode is, for example, a printing mode in which a glossy layer is formed with gloss ink on a color image formed from color dots. In this example, glossy color printing mode based on four-pass printing is presented. Note that the four-pass printing is carried out using half of each nozzle row 44, so compared to when ink is discharged from all nozzles of the nozzle row 44, the feeding length (feeding amount) at the time of feeding operation is about ½, but the need for a reverse feeding operation when printing a glossy layer is obviated. The right-hand side of the drawing illustrates the appearance of dots in the region 2, the region 4, the region 6, and the region 8.

In the glossy color printing mode, the controller 60 may cause the upstream-side nozzle row 441 of the color ink nozzle row to discharge color inks and the downstream-side nozzle row 442 of the gloss ink nozzle row to discharge gloss ink while having the upstream-side irradiator 52 lit, the intermediate irradiator 53 extinguished, and the downstream-side irradiator 54 (the printless region irradiator 55) lit in each pass. The controller 60 may cause such a pass and the feeding operation to be performed alternately. In the "region 1" through the "region 4", color dots may be formed with color inks on the medium M, and the color dots immediately after formation may be irradiated with light by the upstream-side irradiator 52 and be cured (or semi-cured). In the "region 2" through the "region 4", color dots may be additionally formed in the region in which color dots were formed in the immediately preceding pass. Here, the color dots that were formed in the immediately preceding pass have been cured by being irradiated with light immediately after formation, so a condition can be achieved in which when color dots are formed additionally in the "region 2" through the "region 4", the color dots do not bleed easily. That is, bleeding can be limited in the color image formed from color dots.

After all of the color dots to be formed have been formed, in the "region 5" through the "region 8", gloss dots may be formed with gloss ink on the medium M. The intermediate irradiator 53 is extinguished, so almost no light is radiated onto the gloss dots immediately after formation and the gloss dots immediately after formation are not cured. Accordingly, when gloss dots are formed in the "region 5" through the "region 8", the uncured gloss ink dots bond to each other, and thus a film (glossy film or a glossy layer) of gloss ink with a smooth surface is formed. Then, the film of gloss ink with a smooth surface may be irradiated with light from the downstream-side irradiator 54 in regions (for example, the "region 9" and the "region 10") farther on the downstream side in the feeding direction than the "region 8", and thus be cured. Accordingly, a glossy layer with a smooth surface is able to be formed on the color image.

The "region 5" through the "region 8" corresponding to the printing region of the downstream-side nozzle row 442 may be irradiated with light leaking from the upstream-side irradiator 52 and/or the downstream-side irradiator 54 (see FIGS. 8 and 9). However, radiation intensity in most of these regions is a smaller value than P1 (half the maximum Pmax). Accordingly, a condition is achieved in which most of the gloss dots formed in the "region 5" through the "region 8" do not cure easily, so most of the gloss dots are easily smoothened.

In this preferred embodiment, at least a portion of the printing region irradiator 51 on the downstream side in the feeding direction may be disposed farther on the downstream side in the feeding direction than the downstream end of the nozzle row 44, and the downstream-side irradiator 54 may be disposed farther on the downstream side in the feeding direction than the downstream end of the nozzle row 44. Accordingly, radiation intensity P3 (see the graph on the left-hand side in FIG. 9) at the position of the lower end of the nozzle row 44 is a value smaller than P1 (half the maximum Pmax), and thus light radiated onto the "region 8 (and the region 7)" (light leaking from the downstream-side irradiator 54) is relatively weak. Accordingly, a condition is achieved in which the gloss dots formed in the "region 8" do not cure easily. Thus, a film (glossy layer) of gloss ink with a smooth surface is able to be formed stably.

A partial region of the "region 5" on the upstream side may be irradiated with light radiated from the upstream-side irradiator 52 and having a higher radiation intensity than P1. Accordingly, the gloss dots formed in the partial region of the "region 5" on the upstream side are irradiated immediately after formation with light radiated from the upstream-side irradiator 52 and having a higher radiation intensity than P1, so these gloss dots are cured (or semi-cured) immediately after formation. However, the region in the "region 5" irradiated with light having a higher radiation intensity than P1 is extremely small, and in this extremely small region, gloss dots are formed by multi-pass printing so as to be distributed in the feeding direction; therefore, the amount of gloss dots that are cured (or semi-cured) immediately after formation is extremely small. Moreover, in the "region 6" through the "region 8", gloss dots may be formed upon the gloss dots having been cured (or semi-cured) in the "region 5", and at this time, accordingly, a film of gloss ink with a smooth surface may be formed upon the gloss dots having been cured (or semi-cured) in the "region 5". Thus, in this preferred embodiment, although the gloss dots formed in the partial region of the "region 5" on the upstream side may be cured (or semi-cured) immediately after formation, the influence thereof is negligible.

In the glossy color printing mode as well, there may be a difference in the number of times gloss dots formed in the "region 5" through the "region 8" are irradiated. However, since the radiation intensity of light radiated from the downstream-side irradiator 54 onto the printing region (the "region 5" through the "region 8") of the downstream-side nozzle row 442 is low, the difference in gloss dot curing degree due to the difference in the number of times of irradiation is small. Furthermore, the change in radiation intensity in the printing region of the downstream-side nozzle row 442 (the "region 5" through the "region 8") is relatively mild and gloss dots irradiated different numbers of times are distributed through multi-pass printing, so the difference in gloss dot curing degree is not conspicuous. For such reasons, in the glossy color printing mode as well, even if light leaking to the upstream side from the downstream-side irradiator 54 is radiated on the printing region (the "region 5" through the "region 8") of the downstream-side nozzle row 442, formation of stripes in the film of gloss ink is able to be limited.

Figure 12:
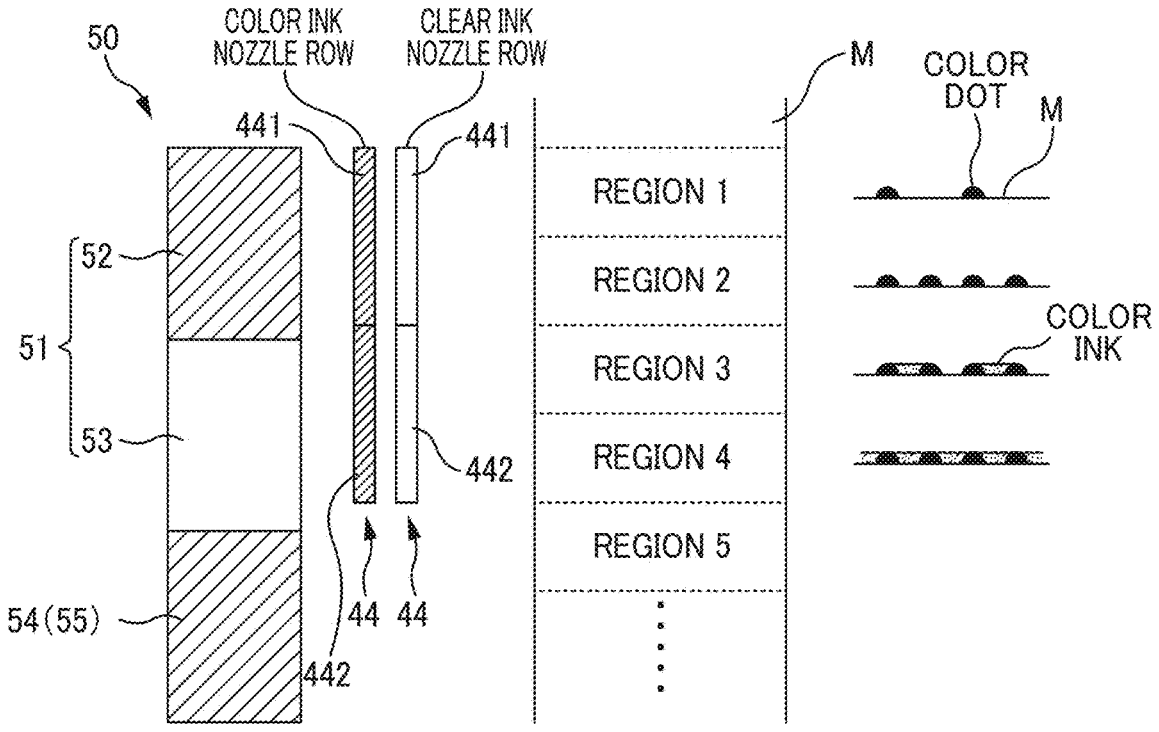
FIG. 12 is an explanatory diagram illustrating a manner in which dots are formed in smooth color printing mode.

FIG. 12 is an explanatory diagram illustrating a manner in which dots are formed in smooth color printing mode. The smooth color printing mode is a printing mode in which a color image with a smooth surface is formed. In this example, smooth color printing mode based on four-pass printing is presented.

In the smooth color printing mode, the controller 60 may cause the upstream-side nozzle row 441 and the downstream-side nozzle row 442 of the color ink nozzle row to discharge color ink while having the upstream-side irradiator 52 lit, the intermediate irradiator 53 extinguished, and the downstream-side irradiator 54 (the printless region irradiator 55) lit in each pass. The controller 60 may cause such a pass and the feeding operation to be performed alternately. In the "region 1" and the "region 2", color dots may be formed on the medium M with color ink discharged from the upstream-side nozzle row 441, and the color dots immediately after formation may be irradiated with light by the upstream-side irradiator 52 and be cured (or semi-cured). In the "region 2", color dots may be additionally formed in the region in which color dots were formed in the immediately preceding pass. Here, the color dots that were formed in the immediately preceding pass have been cured by being irradiated with light immediately after formation, so a condition can be achieved in which when color dots are formed additionally in the "region 2", the color dots do not bleed easily.

In the "region 3" and the "region 4", color dots may be formed on the medium M with color ink discharged from the downstream-side nozzle row 442. The intermediate irradiator 53 is extinguished, so almost no light is radiated onto the gloss dots immediately after formation and the gloss dots immediately after formation are not cured. Accordingly, the color dots formed in the "region 3" and the "region 4" (color dots formed by the downstream-side nozzle row 442) may wet and spread over the medium M gradually and be smoothened. Meanwhile, the color dots having been formed in the "region 1" and the region 2" are already cured (or semi-cured), so the uncured color ink discharged onto the "region 3" and the "region 4" does not mix with the color dots having been formed in the "region 1" and the "region 2", and bleeding can therefore be limited. The color dots having been formed in the "region 1" and the "region 2" are already cured (or semi-cured), so the uncured color ink may wet and spread between the already cured color dots and be smoothened. The uncured color ink in the "region 3" and the "region 4" may be irradiated with light from the downstream-side irradiator 54 (the printless region irradiator 55) in regions (for example, the "region 5") farther on the downstream side than the "region 4" in the feeding direction, and thus be cured. Accordingly, a color image with a smooth surface can be formed on the medium M.

The "region 3" and the "region 4" corresponding to the printing region of the downstream-side nozzle row 442 may be irradiated with light leaking from the upstream-side irradiator 52 and/or the downstream-side irradiator 54 (see FIGS. 8 and 9). However, radiation intensity in most of these regions is a smaller value than P1 (half the maximum Pmax).

Accordingly, a condition is achieved in which most of the color dots formed in the "region 3" and the "region 4" do not cure easily, so most of the color dots are easily smoothened.

In this preferred embodiment, at least a portion of the printing region irradiator 51 on the downstream side in the feeding direction may be disposed farther on the downstream side in the feeding direction than the downstream end of the nozzle row 44, and the downstream-side irradiator 54 may be disposed farther on the downstream side in the feeding direction than the downstream end of the nozzle row 44. Accordingly, radiation intensity P3 (see the graph on the left-hand side in FIG. 9) at the position of the lower end of the nozzle row 44 is a value smaller than P1 (half the maximum Pmax), and thus light radiated onto the "region 4" (light leaking from the downstream-side irradiator 54) is relatively weak. Accordingly, a condition is achieved in which the color dots formed in the "region 4" do not cure easily. Thus, color ink with a smooth surface is able to be formed stably.

A partial region of the "region 3" on the upstream side may be irradiated with light radiated from the upstream-side irradiator 52 and having a higher radiation intensity than P1. Accordingly, the color dots formed in the partial region of the "region 3" on the upstream side are irradiated immediately after formation with light radiated from the upstream-side irradiator 52 and having a higher radiation intensity than P1, so these color dots are cured (or semi-cured) immediately after formation. However, in the smooth color printing mode, the ink discharged from the upstream-side nozzle row 441 and the ink discharged from the downstream-side nozzle row 442 are identical, so the color dots (color dots cured immediately after formation) in the partial region of the "region 3" on the upstream side are almost indistinguishable from the color dots formed in the "region 2". Thus, even if the color dots in the partial region of the "region 3" on the upstream side are cured immediately after formation, this does not affect the quality of the color image.

In the smooth color printing mode, there may be a difference in the number of times color dots formed in the "region 3" and the "region 4" are irradiated. However, since the radiation intensity of light radiated from the downstream-side irradiator 54 onto the printing region (the "region 3" and the "region 4") of the downstream-side nozzle row 442 is low, the difference in color dot curing degree due to the difference in the number of times of irradiation is small. Furthermore, the change in radiation intensity in the printing region of the downstream-side nozzle row 442 (the "region 3" and the "region 8") is relatively mild and color dots irradiated different numbers of times are distributed through multi-pass printing, so the difference in color dot curing degree is not conspicuous. For such reasons, in the smooth color printing mode as well, even if light leaking to the upstream side from the downstream-side irradiator 54 is radiated on the printing region (the "region 3" and the "region 4") of the downstream-side nozzle row 442, formation of stripes in the color image is able to be limited.

Figure 13:
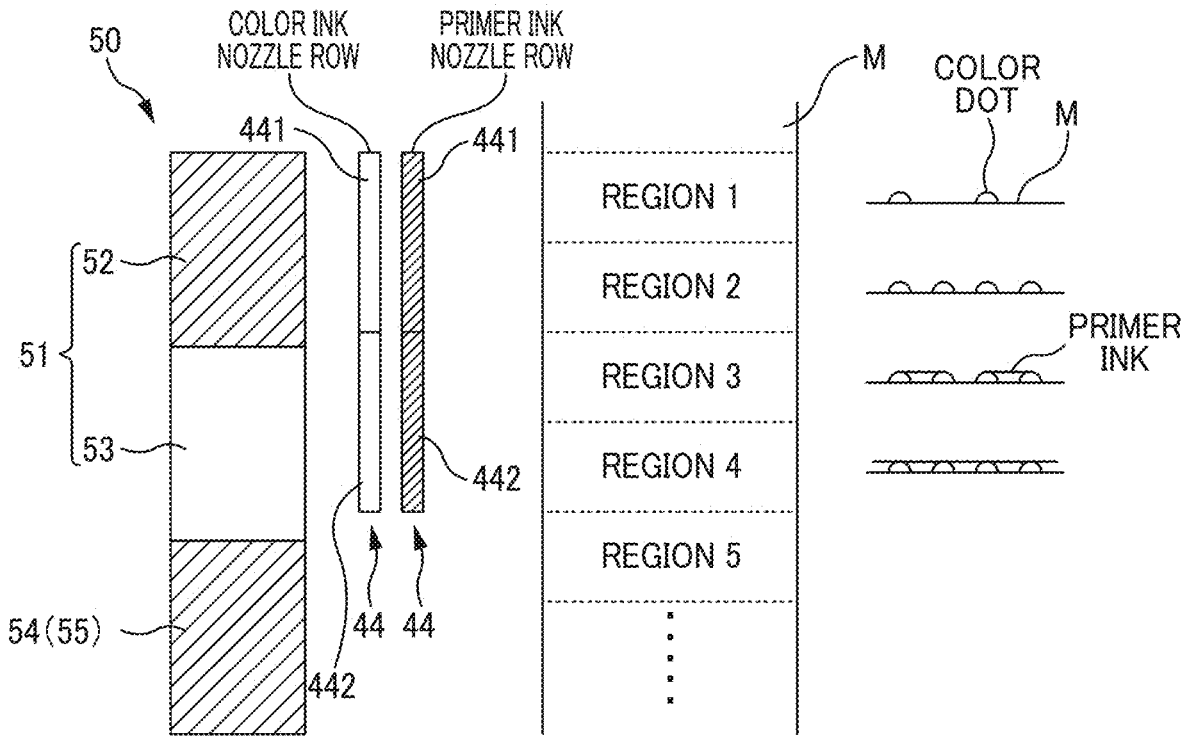
FIG. 13 is an explanatory diagram illustrating a manner in which dots are formed in primer printing mode.

FIG. 13 is an explanatory diagram illustrating a manner in which dots are formed in primer printing mode. The primer printing mode is a printing mode in which primer ink (ground adjustment ink) is applied onto the medium M so as to be smooth. In this example, primer printing mode based on four-pass printing is presented.

In the primer printing mode, the controller 60 may cause the upstream-side nozzle row 441 and the downstream-side nozzle row 442 of the primer ink nozzle row to discharge primer ink while having the upstream-side irradiator 52 lit, the intermediate irradiator 53 extinguished, and the downstream-side irradiator 54 (the printless region irradiator 55) lit in each pass. The controller 60 may cause such a pass and the feeding operation to be performed alternately. In the "region 1" and the "region 2", color dots may be formed on the medium M with primer ink discharged from the upstream-side nozzle row 441, and the dots immediately after formation may be irradiated with light by the upstream-side irradiator 52 and be cured (or semi-cured).

In the "region 3" and the "region 4", dots may be formed on the medium M with primary ink discharged from the downstream-side nozzle row 442. The intermediate irradiator 53 is extinguished, so almost no light is radiated onto the dots immediately after formation and the dots immediately after formation are not cured. Accordingly, the dots (the dots formed by the downstream-side nozzle row 442) formed in the "region 3" and the "region 4" wets and spreads over the medium M gradually. Meanwhile, the dots having been formed in the "region 1" and the region 2" are already cured (or semi-cured), so the uncured primer ink discharged onto the "region 3" and the "region 4" does not mix with the dots having been formed in the "region 1" and the "region 2" and may wet and spread between the already cured dots. The uncured primer ink in the "region 3" and the "region 4" may be irradiated with light from the downstream-side irradiator 54 in regions (for example, the "region 5") farther on the downstream side than the "region 4" in the feeding direction, and thus be cured. Accordingly, primer ink (ground adjustment ink) that is applied so as to be smooth can be fixed on the medium M.

The "region 3" and the "region 4" corresponding to the printing region of the downstream-side nozzle row 442 may be irradiated with light leaking from the upstream-side irradiator 52 and/or the downstream-side irradiator 54 (see FIGS. 8 and 9). However, radiation intensity in most of these regions is a smaller value than P1 (half the maximum Pmax). Accordingly, a condition is achieved in which most of the dots formed in the "region 3" and the "region 4" do not cure easily, so most of the dots are easily smoothened.

In this preferred embodiment, at least a portion of the printing region irradiator 51 on the downstream side in the feeding direction may be disposed farther on the downstream side in the feeding direction than the downstream end of the nozzle row 44, and the downstream-side irradiator 54 may be disposed farther on the downstream side in the feeding direction than the downstream end of the nozzle row 44. Accordingly, radiation intensity P3 (see the graph on the left-hand side in FIG. 9) at the position of the lower end of the nozzle row 44 is a value smaller than P1 (half the maximum Pmax), and thus light radiated onto the "region 4" (light leaking from the downstream-side irradiator 54) is relatively weak. Accordingly, a condition is achieved in which the dots formed in the "region 4" do not cure easily. Thus, primary ink is able to be applied so as to be smooth.

A partial region of the "region 3" on the upstream side may be irradiated with light radiated from the upstream-side irradiator 52 and having a higher radiation intensity than P1. Accordingly, the dots formed in the partial region of the "region 3" on the upstream side are irradiated immediately after formation with light radiated from the upstream-side irradiator 52 and having a higher radiation intensity than P1, so these dots are cured (or semi-cured) immediately after formation. However, in the primer printing mode, the ink discharged from the upstream-side nozzle row 441 and the ink discharged from the downstream-side nozzle row 442 are identical, so the dots (dots cured immediately after formation) in the partial region of the "region 3" on the upstream side are almost indistinguishable from the dots formed in the "region 2". Thus, even if the dots in the partial region of the "region 3" on the upstream side are cured immediately after formation, this does not impact the dips and bumps on the surface of the primer ink fixed on the medium M.

In the primer printing mode, there may be a difference in the number of times dots formed in the "region 3" and the "region 4" are irradiated. However, since the radiation intensity of light radiated from the downstream-side irradiator 54 onto the printing region (the "region 3" and the "region 4") of the downstream-side nozzle row 442 is low, the difference in dot curing degree due to the difference in the number of times of irradiation is small. Furthermore, the change in radiation intensity in the printing region of the downstream-side nozzle row 442 (the "region 3" and the "region 4") is relatively mild and dots irradiated different numbers of times are distributed through multi-pass printing, so the difference in dot curing degree is not conspicuous. For such reasons, in the primer printing mode as well, even if light leaking to the upstream side from the downstream-side irradiator 54 is radiated on the printing region (the "region 3" and the "region 4") of the downstream-side nozzle row 442, formation of stripes in the surface of primer ink fixed on the medium M is able to be limited.

After all dots (dots that are to be formed) have been formed on the medium M, a portion of the dots may not have been irradiated with light having sufficient energy and may not have cured adequately. Thus, even after all dots have been formed on the medium M, the inadequately cured dots may have to be irradiated with light. Processing for such irradiation of inadequately cured dots with light after formation of all dots may be referred to as "terminal processing" in the description below.

FIGS. 14A through 14C are explanatory diagrams of terminal processing in a reference example.

FIG. 14A is an explanatory diagram illustrating the state of a pass when formation of all dots on the medium M has been completed. The "print complete region" in the drawing is a region in which dots that are to be formed on the medium M have been formed and the dots have been cured by being irradiated with light having sufficient energy. On the upstream side from the print complete region in the feeding direction, there is a region in which curing of dots is inadequate (a region in which the energy of radiated light is smaller than in the print complete region). In the description below, a region in which dots to be formed on the medium M have been formed yet curing of the dots is inadequate may be referred to as "curing inadequacy region". Within the "curing inadequacy region", a region that is closer to the "print complete region" is associated with a greater number of times (number of passes) light has been radiated thereon from the irradiator 50 and has been subject to greater irradiation energy. On the contrary, within the "curing inadequacy region", a region that is farther from the "print complete region" is associated with a smaller number of times (number of passes) light has been radiated thereon from the irradiator 50 and has been subject to smaller irradiation energy. In this example, it is assumed that there are "1-pass", "2-pass", and "3-pass" "curing inadequacy regions" in order of increasing distance from the "print complete region", where curing is inadequate in an amount equivalent to one pass, two passes, and three passes, respectively. Note, however, that according to factors such as the number of passes in multi-pass printing, type of printing mode, the feeding length (feeding amount) at the time of feeding operation, and so forth, there may be "curing inadequacy regions" equivalent to four or more passes. The length X (width) in the feeding direction of a "curing inadequacy region" equivalent to a given number of passes corresponds to the feeding length (feeding amount) at the time of a given feeding operation that is carried out in order to form dots on the medium M.

In the terminal processing, the curing inadequacy regions illustrated in FIG. 14A are irradiated with light from the irradiator 50. When doing so, the terminal processing can be completed earlier if, for example, the radiated light has greater energy than the light that was radiated from the irradiator 50 at the time of dot formation. If so, however, a condition for radiating light onto the print complete region and a condition for radiating light onto the curing inadequacy region will be dissimilar, so image quality in the print complete region and image quality in the curing inadequacy region after printing has been completed may be dissimilar, resulting in possible print unevenness. For example, when a period extending from dot formation up to light radiation differs between the print complete region and the curing inadequacy region, the manner in which dots wet and spread is different, and the shape of dots is different; thus, image quality may differ between the printing complete region and the curing inadequacy region after printing has been completed, resulting in possible print unevenness. Thus, in the terminal processing, it is desirable that light be radiated onto each curing inadequacy region from the irradiator 50 in a manner in which the condition remains the same as when light is radiated onto the print complete region.

In view of the above, in the terminal processing in the reference example, the controller 60 repeats a feeding operation equivalent to that performed at the time of dot formation (see FIG. 14B) and a pass equivalent to that performed at the time of dot formation (see FIG. 14C). In this example, the controller 60 repeats three times a set of: a feeding operation equivalent to that performed at the time of dot formation; and a pass equivalent to that performed at the time of dot formation. Here, as illustrated in FIG. 14C, the controller 60, when causing the carriage 21 to move in the scanning direction, lights the irradiator 50 without causing the nozzles to discharge ink. In the description below, such a pass that is performed for the terminal processing may be referred to as a "terminal pass". In this example, it is assumed that the downstream-side irradiator 54 has been lit at the time of dot formation and the downstream-side irradiator 54 is lit also in the terminal pass. According to this terminal processing in the reference example, the condition for radiating light onto the curing inadequacy regions and the condition for radiating light onto the print complete region are equalized, so even image quality is achieved across the printing complete region and the curing inadequacy regions after printing has been completed, and print unevenness is able to be limited accordingly.

In the terminal processing in the reference example, the feeding operation is further repeated even after formation of all dots on the medium M has been completed. In other words, in the terminal processing in the reference example, the medium M needs to be fed to the downstream side in the feeding direction even after formation of all dots on the medium M has been completed. Thus, in the reference example, space is required in which the medium M can be ejected by an amount by which the medium M is fed at the time of terminal processing.

FIGS. 15A through 15C are explanatory diagrams of terminal processing in this preferred embodiment.

FIG. 15A is an explanatory diagram illustrating the state of a pass when formation of all dots on the medium M has been completed. This drawing is equivalent to FIG. 14A corresponding to the aforementioned reference example. In this example, it is assumed that there are "1-pass", "2-pass", and "3-pass" "curing inadequacy regions" in order of increasing distance from the "print complete region", where curing is inadequate in an amount equivalent to one pass, two passes, and three passes, respectively. Moreover, in this example, it is assumed that the downstream-side irradiator 54 was lit at the time of dot formation.

In the terminal processing in this preferred embodiment, following the immediately preceding pass (see FIG. 15A), the controller 60 may not perform the feeding operation but perform a standby operation for standing by for a period of time equivalent to a single feeding operation, as illustrated in FIG. 15B. The provision of such a standby operation enables adjustment of a period extending from formation of dots in a curing inadequacy region up to light radiation. Note, however, that such time adjustment serves the purpose of equalizing the condition for radiating light onto the curing inadequacy regions with the condition for when light is radiated onto the print complete region, and in cases where it is sufficient to provide an adequate amount of light radiation onto a curing inadequacy region, the standby operation may be omitted. To cite an example, in a case where smoothing has been achieved (wetting and spreading of dots is complete) in a curing inadequacy region, a standby period for smoothing is not required and thus the standby operation is not required either.

Following the standby operation, as illustrated in FIG. 15C, the controller 60 may cause the carriage 21 to move in the scanning direction and light the irradiator 50 without causing the nozzles to discharge ink (terminal pass). For a terminal pass, the controller 60 may change a region lit in the irradiator 50 from the immediately preceding pass (which may be a terminal pass). Specifically, the controller 60 change a region lit in the irradiator 50 so that the region is farther on the upstream side in the feeding direction by an amount equivalent to a single feeding length X relative to the region that was lit in the immediately preceding pass. For example, the controller 60 may light the downstream-side irradiator 54 in the pass illustrated in FIG. 15A, so in the terminal pass illustrated in FIG. 15C, may light the range of the length L21 that is farther on the upstream side in the feeding direction by an amount equivalent to a single feeding length X relative to the downstream-side irradiator 54. In other words, the controller 60 may extinguish the range of the length X from the downstream end of the downstream-side irradiator 54 while lighting the portion of the downstream-side irradiator 54 farther on the upstream side in the feeding direction than the extinguished range and also lighting a range equivalent to the length X in the intermediate irradiator 53 on the downstream side, so as to light the range of the length L21 that is farther on the upstream side in the feeding direction by an amount equivalent to a single feeding length X relative to the downstream-side irradiator 54. Accordingly, light can be radiated onto a curing inadequacy region similarly to the terminal pass in the reference example in FIG. 14C without feeding the medium M.

In this preferred embodiment, the controller 60 may repeat, in alternating fashion: the standby operation for standing by for a period of time equivalent to a single feeding operation; and the terminal pass in which the region lit in the irradiator 50 is changed from the immediately preceding pass (including a terminal pass). In this example, the controller 60 repeats the set of the standby operation and the terminal pass three times. Accordingly, the condition for radiating light onto the curing inadequacy regions illustrated in FIG. 15A and the condition for radiating light onto the print complete region are equalized, making it possible to achieve even image quality across the printing complete region and the curing inadequacy regions after printing has been completed, limiting print unevenness. According to this preferred embodiment, there is no need to feed the medium M to the downstream side in the feeding direction during the terminal processing, and thus space is able to be reduced in the printing apparatus 1 compared to the reference example (FIGS. 14A through 14C).

Note that in this preferred embodiment, the region lit in the irradiator 50 may be set so as to conform to the length of curing inadequacy regions in the feeding direction, but the present invention is not limited to this, and a region lit in the irradiator 50 may be freely set within a range that is wider than the curing inadequacy regions given that the range encompasses the curing inadequacy regions. For example, given that the curing inadequacy regions are able to be encompassed, the downstream-side irradiator 54 encompassing the range of the length X from the downstream end of the downstream-side irradiator 54 may be lit and the range equivalent to the length X in the intermediate irradiator 53 on the downstream side may also be lit. In other words, changing a range to be lit may involve not only moving (shifting) a range to be lit but also increasing the same. Moreover, an upstream side may be lit without a downstream side being lit. Further, to cite another example, given that the curing inadequacy regions are able to be encompassed, the upstream-side irradiator 52 and the intermediate irradiator 53 may be lit while the downstream-side irradiator 54 is extinguished. In this case, light may be radiated onto the print complete region as well, but even if light is radiated onto the print complete region, since curing has already been completed in the print complete region, there will hardly be any problem in terms of print quality. Meanwhile, since control for achieving conformity with a region lit in the irradiator 50 is not required; thus, with a simpler configuration, even image quality is achieved across the printing complete region and the curing inadequacy regions, and print unevenness thus is able to be limited.

In the terminal processing described above, the range of the length L21 that is farther on the upstream side in the feeding direction by an amount equivalent to a single feeding length X relative to the downstream-side irradiator 54 is lit (see FIG. 15C). However, a region to be lit in terminal processing is not limited to this. In the modification, the range and the length of a region lit is changed. Note that, as illustrated in FIG. 8, if a member that blocks light, such as the frame 50C, is present on an end of the region lit, the change in radiation intensity at that location is quick (see, for example, the slope at the position of the circled 2 in the graph in FIG. 8), but if no such member to block light is present on an end of the region lit, then light leaks outside that location, so the change in radiation intensity at that location (the slope at the position of the circled 3 in the graph) is relatively mild. Thus, a region in which light leaks farther on the downstream side than the region lit in the terminal pass illustrated in FIG. 15C (first terminal pass) is considered to be wider than a region in which light leaks farther on the downstream side than the downstream-side irradiator 54 in the pass illustrated in FIG. 15A (pass during dot formation). Accordingly, it is considered that a small surplus in light irradiation amount is prone to occur at the upstream end of the print complete region in FIG. 15C.

FIGS. 16A through 16C are explanatory diagrams of terminal processing in a modification of a preferred embodiment of the present invention. In the modification as well, the controller 60 may repeat, in alternating fashion: the standby operation for standing by for a period of time equivalent to a single feeding operation; and the terminal pass in which the region lit in the irradiator 50 is changed from the immediately preceding pass (including a terminal pass).

For the first terminal pass in the modification (see FIG. 16B), the controller 60 may change the region to be lit to be farther on the upstream side in the feeding direction by an amount equivalent to a single feeding length X relative to the printless region irradiator 55 (the downstream-side irradiator 54) having been lit in the immediately preceding pass for dot formation (see FIG. 16A). Note that in the modification, the controller 60 may set the range to be extinguished at the downstream end of the printless region irradiator 55 not to a single feeding length X but to X' that is slightly greater than the single feeding length X. That is, in the modification, in the first terminal pass, the controller 60 may extinguish the range of the length X' from the downstream end of the printless region irradiator 55 while lighting the portion of the printless region irradiator 55 farther on the upstream side in the feeding direction than the extinguished range and also lighting a range equivalent to the length X (single feeding length) in the intermediate irradiator 53 on the downstream side, thus lighting the range of a length L21' that is slightly longer than the printless region irradiator 55 on the upstream side from the printless region irradiator 55 in the feeding direction. Note that although the length L21' of the region lit in the terminal pass is slightly smaller than the length L21 of the region lit (the printless region irradiator 55) in the pass at the time of dot formation, there is no member to block light, such as the frame 50C, at the downstream end of the region lit in the terminal pass, so light leaks further to the downstream side than the region lit; thus, the range irradiated with light is roughly equivalent to the pass at the time of dot formation. In the modification, accordingly, it is possible to reduce or prevent occurrence of a surplus in the amount of light radiated onto the upstream end of the print complete region.

From the second terminal pass onward, the controller 60 may change the region lit in the irradiator 50 to be farther on the upstream side in the feeding direction by an amount equivalent to a single feeding length X relative to the region that was lit in the immediately preceding terminal pass. For example, in the second terminal pass illustrated in FIG. 16C, the controller 60 lights the range of the length L21' of the irradiator 50 so that the range is farther on the upstream side in the feeding direction by an amount equivalent to a single feeding length X compared to the first terminal pass. Moreover, for the second terminal pass illustrated in FIG. 16C, the controller 60 may lengthen the extinguished region on the downstream end side by an amount equivalent to a single feeding length X compared to the extinguished region on the downstream end side for the first terminal pass.

In the modification as well, light is able to be radiated onto a curing inadequacy region similarly to the terminal pass in the reference example in FIG. 14C without feeding the medium M. According to the modification as well, there is no need to feed the medium M to the downstream side in the feeding direction during terminal processing, and thus space is able to be reduced in the printing apparatus 1 compared to the reference example (FIGS. 14A through 14C).

Second Preferred Embodiment

Figure 17:
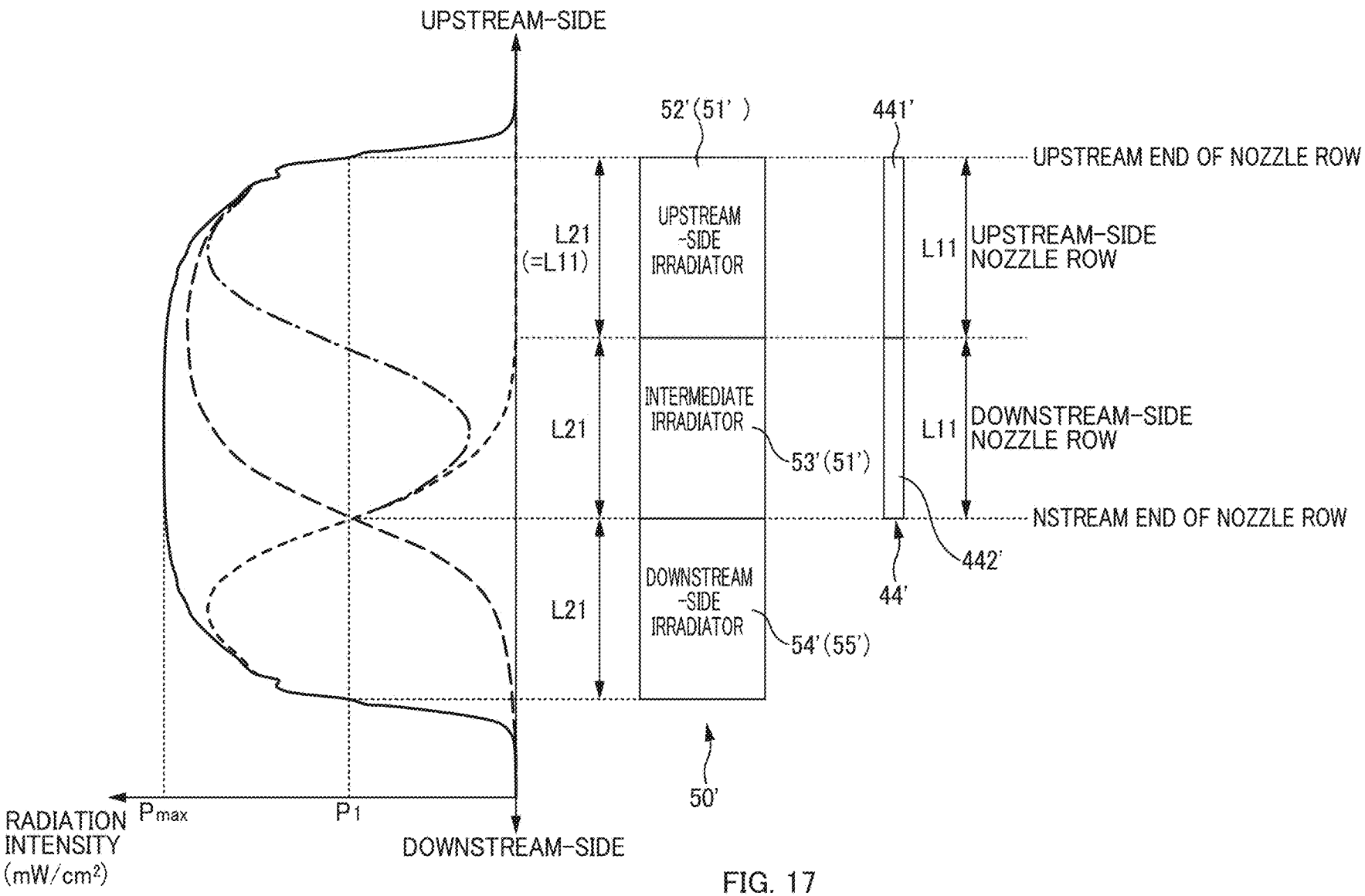
FIG. 17 is an explanatory diagram of a configuration of a second preferred embodiment of the present invention.

FIG. 17 is an explanatory diagram of a configuration of a second preferred embodiment of the present invention. In the second preferred embodiment, the length of a printing region irradiator 51' may be equal to the length of a nozzle row 44', the length of an upstream-side irradiator 52' may be equal to the length of an upstream-side nozzle row 441', and the length of an intermediate irradiator 53' may be equal to the length of a downstream-side nozzle row 442'. Accordingly, the position of the downstream end of the nozzle row 44' may be set to be at a boundary portion between the intermediate irradiator 53' and the downstream-side irradiator 54'. Thus, while in the first preferred embodiment, at least a portion of the printing region irradiator 51 on the downstream side in the feeding direction (i.e. at least a portion of the intermediate irradiator 53 on the downstream side in the feeding direction) is disposed farther on the downstream side in the feeding direction than the downstream end of the nozzle row 44, the second preferred embodiment does not adopt such a configuration.

In the second preferred embodiment as described above, when the printing region irradiator 51' is lit and a printless region irradiator 55' (the downstream-side irradiator 54') is extinguished, radiation intensity at the position of the downstream end of the nozzle row 44' may be about P1. In addition, also when the printing region irradiator 51' is extinguished and the printless region irradiator 55' is lit, radiation intensity at the position of the downstream end of the nozzle row 44' may be about P1. In this way, in this preferred embodiment, radiation intensity at the downstream end of the nozzle row 44' when the printing region irradiator 51' is extinguished and the printless region irradiator 55' is lit and radiation intensity at the same position when the printing region irradiator 51' is lit and the printless region irradiator 55' is extinguished may both be more or less P1.

In the second preferred embodiment as well, in mixed printing mode, the controller 60 may cause the following pass and the feeding operation to be performed alternately, the pass involving: causing the upstream-side nozzle row 441' and the downstream-side nozzle row 442' to discharge ink while having the upstream-side irradiator 52 and the printless region irradiator 55' (the downstream-side irradiator 54') lit and the intermediate irradiator 53 extinguished (see FIGS. 11 through 13). In the second preferred embodiment, the radiation intensity (P1) at the position of the downstream end of the nozzle row 44' may be higher than the radiation intensity (P3) at the same position in the first preferred embodiment described above. Accordingly, in the second preferred embodiment, dots formed at the downstream end of the nozzle row 44' are more difficult to smoothen compared to the first preferred embodiment described above. However, in the second preferred embodiment as well, it is possible to implement printing by mixing dots cured immediately after formation and dots cured after being smoothened.

If the aforementioned gloss printing mode is performed using the configuration of the second preferred embodiment, since the radiation intensity (P1) at the position of the downstream end of the nozzle row 44' may be higher than the radiation intensity (P3) at the same position in the first preferred embodiment described above, the gloss dots formed at the downstream end of the nozzle row 44' may be difficult to smoothen. Thus, with the configuration of the second preferred embodiment, color printing mode and gloss printing mode may be incompatible to be performed concurrently.

Reference Example

Figure 18:
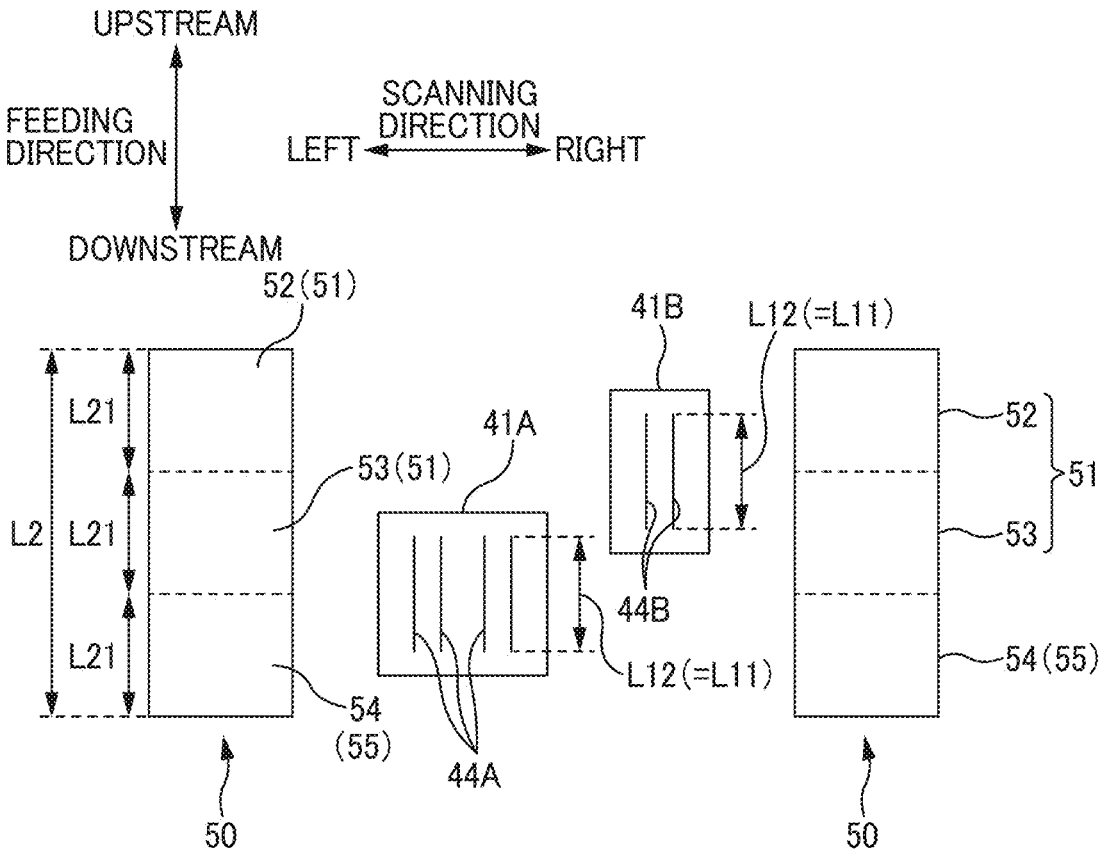
FIG. 18 is an explanatory diagram of disposition of the nozzle row and the irradiator 50 in the reference example.

FIG. 18 is an explanatory diagram of the disposition of the nozzle row and the irradiator 50 in the reference example.

The head 41 includes a color head 41A and a special head 41B. The color head 41A includes a color ink nozzle row 44A to discharge color ink. The special head 41B includes a special ink nozzle row 44B to discharge special ink (clear ink, such as gloss ink or primer ink, white ink, silver ink, etc.). The length of the color ink nozzle row 44A and the length of the special ink nozzle row 44B in the feeding direction are equal. In the description below, L12 denotes the length of the color ink nozzle row and the length of the special ink nozzle row in the feeding direction (note that the length L12 is roughly equivalent to the length L11 mentioned above).

In the reference example, the special head 41B is disposed farther on the upstream side in the feeding direction than the color head 41A. In this example, the position of the upstream end of the color ink nozzle row 44A (the most upstream nozzle from among the plurality of nozzles forming the color ink nozzle row 44A) and the position of the downstream end of the special ink nozzle row 44B (the most downstream nozzle from among the plurality of nozzles forming the special ink nozzle row 44B) in the feeding direction are more or less the same. In other words, in the reference example, the color ink nozzle row 44A and the special ink nozzle row 44B are disposed in staggered fashion (in contrast to this, the color ink nozzle row and the special ink nozzle row in the first preferred embodiment are disposed so as to be side by side in the scanning direction).

In the reference example as well, an irradiator 50 is provided on the lower surface of the carriage 21. The irradiator 50 in the reference example is configured in the same manner as the irradiator 50 in the first preferred embodiment and includes the LED array 50A, the lens array 50B, and the frame 50C (see FIG. 3A). The central portion of the irradiator 50 (the central portion of the intermediate irradiator 53), the upstream end of the color ink nozzle row 44A, and the lower end of the special ink nozzle row 44B are located more or less at the same position in the feeding direction.

In the reference example as well, the irradiator 50 is divided in three into the upstream-side irradiator 52, the intermediate irradiator 53, and the downstream-side irradiator 54, and the controller 60 is capable of controlling lighting and extinguishing of each of the upstream-side irradiator 52, the intermediate irradiator 53, and the downstream-side irradiator 54.

In the reference example, the upstream-side irradiator 52 together with the intermediate irradiator 53 encompass the range of the special ink nozzle row 44B (to discharge special ink) in the feeding direction. Thus, in the reference example, the printing region irradiator 51 corresponding to the special ink nozzle row 44B includes a combination of the upstream-side irradiator 52 and the intermediate irradiator 53. The downstream-side irradiator 54 does not overlap the range of the special ink nozzle row 44B in the feeding direction and is disposed farther on the downstream side in the feeding direction than the special ink nozzle row 44B. Thus, in the reference example, the printless region irradiator 55 corresponding to the special ink nozzle row 44B is defined by the downstream-side irradiator 54.

Figure 19:
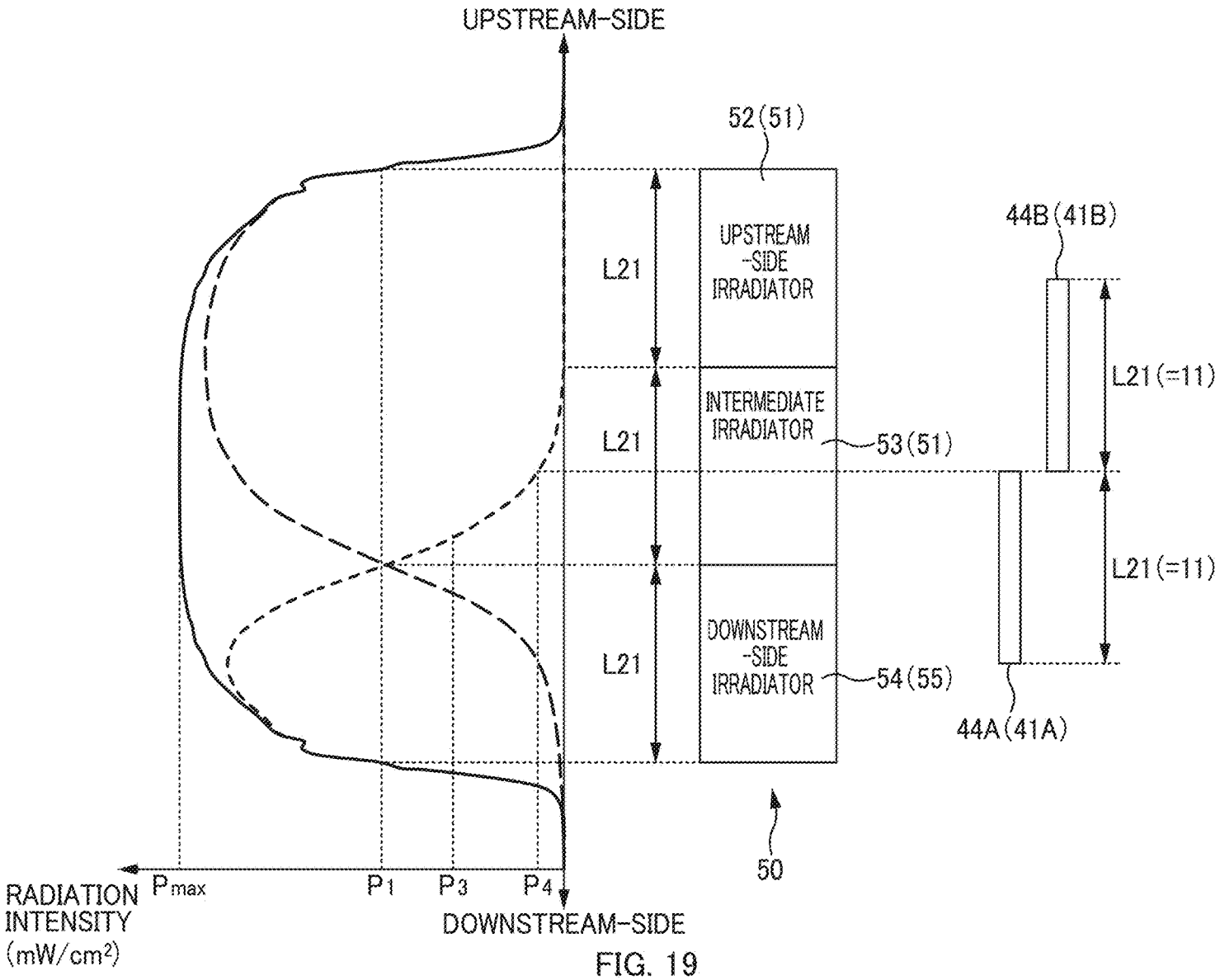
FIG. 19 is a diagram illustrating a positional relationship between the nozzle row and the irradiator 50.

FIG. 19 is a diagram illustrating a positional relationship between the nozzle row and the irradiator 50. The right-hand side of the drawing illustrates the positions of the color ink nozzle row 44A and the special ink nozzle row 44B. The position of the irradiator 50 (the positions of the upstream-side irradiator 52, the intermediate irradiator 53, and the downstream-side irradiator 54) is (are) indicated in the central portion in the drawing. A graph of the radiation intensity of the irradiator is illustrated on the left-hand side in the drawing. The distribution of radiation intensity when the regions of the irradiator 50 are each lit or extinguished is equivalent to that in the aforementioned first preferred embodiment (see FIG. 8)

In the reference example, the irradiator 50 (the upstream-side irradiator 52, the intermediate irradiator 53, and the downstream-side irradiator 54) is disposed so as to encompass a range of the entire nozzle row, defined by the color ink nozzle row 44A and the special ink nozzle row 44B, in the feeding direction. The position of the upstream end of the nozzle row (the positions of the upstream ends of the color ink nozzle row 44A and the special ink nozzle row 44B) is (are) set to be farther on the downstream side in the feeding direction than the upstream end of the irradiator 50 (the upstream end of the upstream-side irradiator 52). The position of the downstream end of the nozzle row (the positions of the downstream ends of the color ink nozzle row 44A and the special ink nozzle row 44B) is (are) set to be farther on the upstream side in the feeding direction than the downstream end of the irradiator 50 (the downstream end of the downstream-side irradiator 54). Thus, when all of the upstream-side irradiator 52, the intermediate irradiator 53, and the downstream-side irradiator 54 are lit, the region on which printing is carried out by the color ink nozzle row 44A and the special ink nozzle row 44B is irradiated with light having a higher radiation intensity than P1 (light having a radiation intensity close to the maximum Pmax). In other words, when all of the upstream-side irradiator 52, the intermediate irradiator 53, and the downstream-side irradiator 54 are lit, the region on which printing is carried out by the color ink nozzle row 44A and the special ink nozzle row 44B is irradiated with light with which photocurable ink can be cured.

In the reference example, the position of the downstream end of the special ink nozzle row 44B (the most downstream nozzle from among the plurality of nozzles forming the special ink nozzle row 44B) is set to be farther on the upstream side in the feeding direction than the boundary portion between the intermediate irradiator 53 and the downstream-side irradiator 54. In other words, at least a portion of the printing region irradiator 51 on the downstream side in the feeding direction (i.e. at least a portion of the intermediate irradiator 53 on the downstream side in the feeding direction) is disposed farther on the downstream side in the feeding direction than the downstream end of the special ink nozzle row 44B. Moreover, the downstream-side irradiator 54 is disposed on the downstream side in the feeding direction, and at an interval, from the downstream end of the special ink nozzle row 44B. Thus, in the reference example as well, when the printing region irradiator 51 is extinguished and the downstream-side irradiator 54 is lit, radiation intensity P4 at the position of the downstream end of the special ink nozzle row 44B is a smaller value than P1 (half the maximum Pmax). Note that the radiation intensity P4 in the reference example is a smaller value than the radiation intensity P3 in the first preferred embodiment (accordingly, in the reference example, dots formed with special ink is easier to smoothen than in the first preferred embodiment).

FIG. 20A is an explanatory diagram illustrating a manner in which dots are formed in color printing mode of the reference example. Here, illustrated is a manner in which four-pass printing is performed. The drawing only illustrates a single color ink nozzle row 44A, but the other color ink nozzle rows discharge color ink equivalently to this color ink nozzle row.

In the reference example as well, in color printing mode, the controller 60 causes all nozzles of the color ink nozzle row 44A to discharge color ink while having the intermediate irradiator 53 and the downstream-side irradiator 54 (i.e., the printing region irradiator corresponding to the color ink nozzle row 44A) lit in each pass. Note that in the color printing mode, smoothening is not required, and dots may be cured, so the upstream-side irradiator 52 (the printless region irradiator corresponding to the color ink nozzle row 44A) may be lit. The controller 60 causes such a pass and the feeding operation to be performed alternately. In the "region 1" through the "region 4", color dots are formed with color inks on the medium M, and the color dots immediately after formation are irradiated with light by the intermediate irradiator 53 and the downstream-side irradiator 54 and be cured (or semi-cured). In the "region 2" through the "region 4", color dots are additionally formed in the region in which color dots were formed in the immediately preceding pass. Here, the color dots that were formed in the immediately preceding pass have been cured by being irradiated with light immediately after formation, so a condition is able to be achieved in which when color dots are formed additionally in the "region 2" through the "region 4", the color dots do not bleed easily.

In the color printing mode in the reference example, the controller 60 lights not only the intermediate irradiator 53 and the downstream-side irradiator 54 (i.e., the printing region irradiator corresponding to the color ink nozzle row 44A) but also the upstream-side irradiator 52 (i.e., the printless region irradiator corresponding to the color ink nozzle row 44A). If the energy of light radiated onto the color dots is sufficient, however, the controller 60 may extinguish the upstream-side irradiator 52 during the color printing mode.

FIG. 20B is an explanatory diagram of a manner in which dots are formed in the special printing mode of the reference example.

In the special printing mode, the controller 60 causes all nozzles of the special ink nozzle row 44B to discharge special ink while having the printing region irradiator 51 (upstream-side irradiator 52 and the intermediate irradiator 53) corresponding to the special ink nozzle row 44B extinguished and the downstream-side irradiator 54 lit in each pass. The controller 60 causes such a pass and the feeding operation to be performed alternately. In the "region 1" through the "region 4", special dots are formed on the medium M with special ink. In the special printing mode, the printing region irradiator 51 is extinguished, so almost no light is radiated onto the special dots immediately after formation and the special dots immediately after formation are not cured. Accordingly, the special dots wet and spread over the medium M gradually and are smoothened. In the "region 2" through the "region 4", special dots are additionally formed in the region in which special dots were formed in the immediately preceding pass. Here, the special dots formed in the immediately preceding pass are uncured, so when special dots are formed additionally in the "region 2" through the "region 4", the dots and the uncured special ink dots are mixed and bond to each other. When adjacent dots bond to each other, the surface is smoothened. Accordingly, when special dots that are to be formed in the "region 4" have been formed, a film (glossy film or glossy layer) of special ink with a smooth surface is formed. Then, the film of special ink with a smooth surface is irradiated with light from the printless region irradiator 55 (the downstream-side irradiator 54) in regions (for example, the "region 7" and the "region 8") farther on the downstream side in the feeding direction than the "region 4", and thus be cured. Accordingly, a glossy layer with a smooth surface is able to be formed on the medium M.

In the reference example, at least a portion of the printing region irradiator 51 on the downstream side in the feeding direction is disposed farther on the downstream side in the feeding direction than the downstream end of the special ink nozzle row 44B, and the downstream-side irradiator 54 is disposed farther on the downstream side in the feeding direction than the downstream end of the special ink nozzle row 44B. Accordingly, radiation intensity P4 (see the graph on the left-hand side in FIG. 19) at the position of the lower end of the special ink nozzle row 44B is a value smaller than P1 (half the maximum Pmax), and thus light radiated onto the "region 4 (and the region 3)" (light leaking from the downstream-side irradiator 54 constituting the printless region irradiator 55) is relatively weak. Accordingly, a condition is achieved in which the special dots formed in the "region 4" do not cure easily. Accordingly, the special dots formed in the "region 4" wet, spread, and are smoothened more easily so that a film (glossy layer) of special ink with a smooth surface is able to be formed stably.

Note that, as illustrated in the graph on the left-hand side in FIG. 19, the radiation intensity P4 in the reference example is a smaller value than the radiation intensity P3 in the first preferred embodiment. Accordingly, in the reference example, as compared to the first preferred embodiment, light radiated onto the "region 4 (and the region 3)" (light leaking from the downstream-side irradiator 54 defining the printless region irradiator 55) is weakened. Accordingly, a condition is achieved in which the special dots formed in the "region 4" in the reference example cure less easily compared the first preferred embodiment. Accordingly, in the reference example, as compared to the first preferred embodiment, the special dots formed in the "region 4" wet, spread, and are smoothened more easily so that a film (glossy layer) of special ink with a smooth surface is able to be formed stably.

In the reference example, as compared to the first preferred embodiment, radiation intensity of light radiated from the printless region irradiator 55 onto the printing region of the special ink nozzle row 44B (the "region 3" and the "region 4") is further weakened, so the difference in special dot curing degree due to the difference in the number of times of irradiation is even smaller. In addition, in the reference example, as compared to the first preferred embodiment, the change in radiation intensity in the printing region of the special ink nozzle row 44B (the "region 3" and the "region 4") is even milder, so the difference in special dot curing degree is less conspicuous.

In the reference example described above, disposing the color ink nozzle row 44A and the special ink nozzle row 44B in staggered fashion makes a reduction in the number of nozzles possible while also making color printing mode and special printing mode compatible to be performed concurrently. Furthermore, in the reference example, as a result of using staggered disposition in which the special ink nozzle row 44B is disposed farther on the upstream side in the feeding direction than the color ink nozzle row 44A, the downstream-side irradiator 54 which radiates light onto color dots immediately after formation in color printing mode can be used as the printless region irradiator 55 in special printing mode.

In the reference example described above, disposing the color ink nozzle row 44A and the special ink nozzle row 44B in staggered fashion makes a reduction in the number of nozzles possible while also making color printing mode and special printing mode compatible to be performed concurrently. Furthermore, in the reference example, as a result of using staggered disposition in which the special ink nozzle row 44B is disposed farther on the upstream side in the feeding direction than the color ink nozzle row 44A, the downstream-side irradiator 54 which radiates light onto color dots immediately after formation in color printing mode can be used as the printless region irradiator 55 in special printing mode.

Figure 21A:
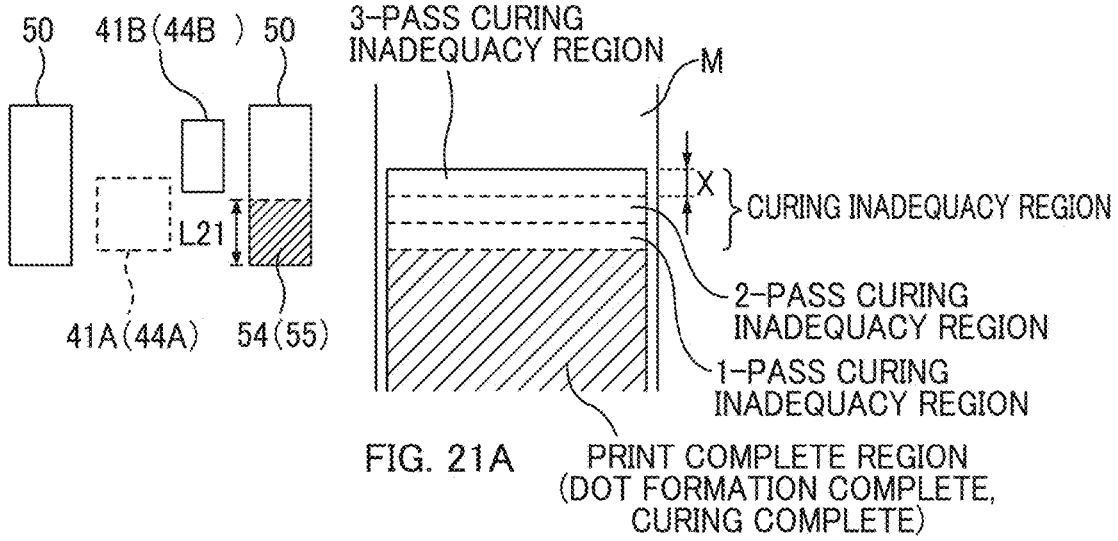
FIGS. 21A through 21C are explanatory diagrams of terminal processing in the reference example.
Figure 21B:
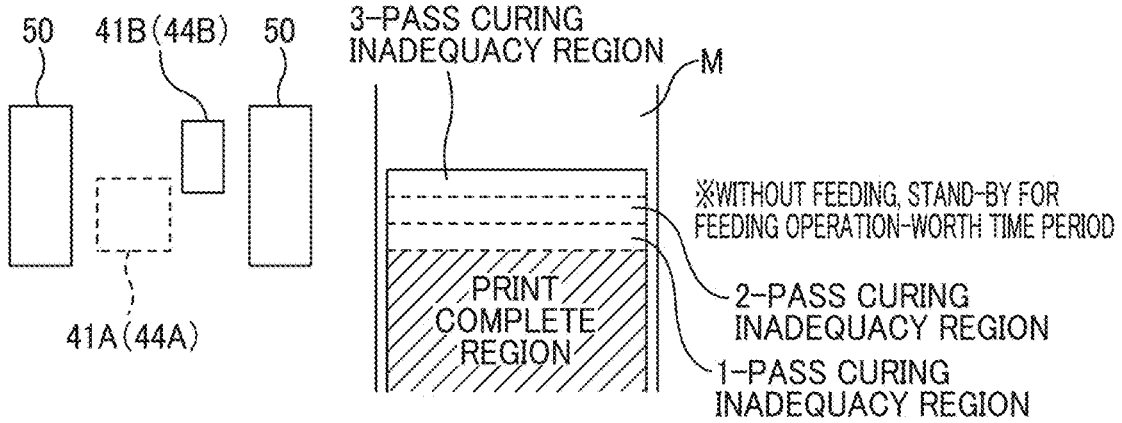
Figure 21C:
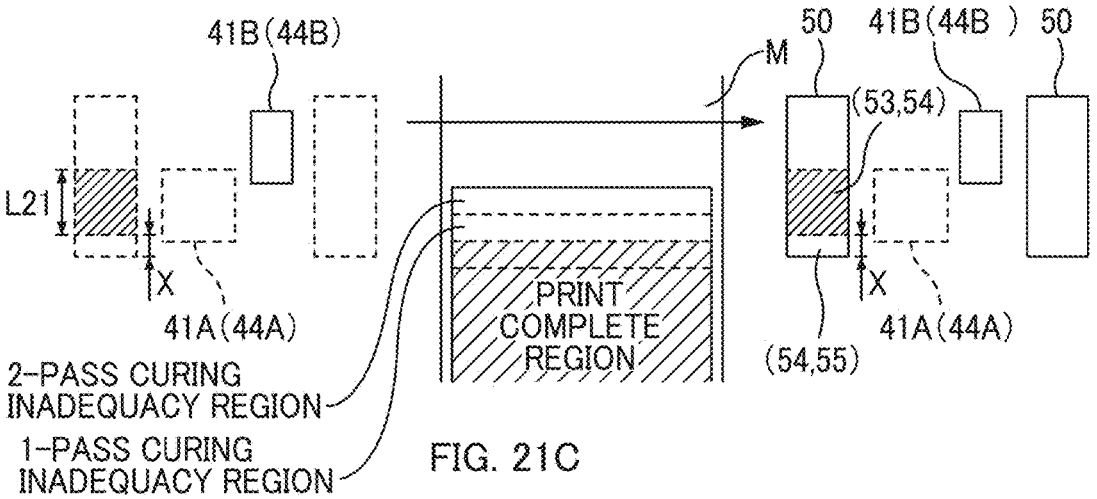

FIGS. 21A through 21C are explanatory diagrams of terminal processing in the reference example.

In the terminal processing in the reference example as well, following the immediately preceding pass (see FIG. 21A), the controller 60 does not perform the feeding operation but performs a standby operation for standing by for a period of time equivalent to a single feeding operation, as illustrated in FIG. 21B. The provision of such a standby operation enables adjustment of a period extending from formation of dots in a curing inadequacy region up to light radiation. Note, however, that such time adjustment serves the purpose of equalizing the condition for radiating light onto a curing inadequacy region with the condition for when light is radiated onto the print complete region, but in cases where it is sufficient to provide an adequate amount of light radiation onto a curing inadequacy region, the standby operation may be omitted. To cite an example, in a case where smoothing has been achieved (wetting and spreading of dots is complete) in a curing inadequacy region, a standby period for smoothing is not required and thus the standby operation is not required either.

Following the standby operation, as illustrated in FIG. 21C, the controller 60 causes the carriage 21 to move in the scanning direction and light the irradiator 50 without causing the nozzles to discharge ink (terminal pass). For the terminal pass, the controller 60 changes a region lit in the irradiator 50 from the immediately preceding pass (which may be a terminal pass). Specifically, the controller 60 changes a region lit in the irradiator 50 so that the region is farther on the upstream side in the feeding direction by an amount equivalent to a single feeding length X relative to the region that was lit in the immediately preceding pass. Accordingly, in the terminal processing in the reference example as well, light is able to be radiated onto a curing inadequacy region without feeding the medium M, similarly to the terminal processing in the first preferred embodiment.

Note that in the terminal processing in the reference example, similarly to the terminal processing in the first preferred embodiment, the region lit in the irradiator 50 is set so as to conform to the length of curing inadequacy regions in the feeding direction, but the present invention is not limited to this, and a region lit in the irradiator 50 may be freely set within a range that is wider than the curing inadequacy regions given that the range encompasses the curing inadequacy regions. In this case, light may be radiated onto the print complete region as well, but even if light is radiated onto the print complete region, since curing has already been completed in the print complete region, there will hardly be any problem in terms of print quality (in the special printing mode, in particular, where dots are smoothened, there will hardly be any problem in terms of print quality). Meanwhile, since control for achieving conformity with a region lit in the irradiator 50 is not required; thus, with a simpler configuration, even image quality is achieved across the printing complete region and the curing inadequacy regions, and print unevenness is thus able to be limited.

The printing apparatus 1 in the aforementioned first preferred embodiment (and the second preferred embodiment) includes a feeder 30, a head 41, an irradiator 50, and a controller (controller) 60. The irradiator 50 is capable of radiating light onto a region longer in the feeding direction than a nozzle row 44, and the controller 60 is capable of dividing the irradiator 50 into an upstream-side irradiator 52, an intermediate irradiator 53, and a printless region irradiator 55 (downstream-side irradiator 54), and individually controlling lighting and extinguishing of each of the irradiators defined by the division. In the preferred embodiment (s), as illustrated in FIG. 9 (and FIG. 17), the upstream-side irradiator 52 overlaps the range of an upstream-side nozzle row 441 in the feeding direction, and the intermediate irradiator 53 overlaps the range of a downstream-side nozzle row 442 in the feeding direction. Meanwhile, the printless region irradiator 55 (the downstream-side irradiator 54) does not overlap the range of the downstream-side nozzle row in the feeding direction and is disposed farther on the downstream side in the feeding direction than the downstream-side nozzle row (see FIGS. 9 and 17). Based on such a configuration, in the first preferred embodiment (and the second preferred embodiment), in mixed printing mode (see FIGS. 11 through 13), the controller 60 causes the following pass and the feeding operation to be performed alternately, the pass involving: causing the upstream-side nozzle row 441 and the downstream-side nozzle row 442 to discharge ink while having the upstream-side irradiator 52 and the printless region irradiator 55 (the downstream-side irradiator 54) lit and the intermediate irradiator 53 extinguished. Accordingly, it is possible to implement printing by mixing dots cured immediately after formation and dots cured after being smoothened. Further, in the aforementioned first preferred embodiment (and the second preferred embodiment), the printless region irradiator 55 (the downstream-side irradiator 54) does not overlap the range of the downstream-side nozzle row 442 in the feeding direction and is disposed farther on the downstream side in the feeding direction than the downstream-side nozzle row 442, so even when the printless region irradiator 55 (the downstream-side irradiator 54) is lit, dots formed by the upstream-side nozzle row 441 and the downstream-side nozzle row 442 (the downstream-side nozzle row 442 in particular) are less prone to be irradiated with light from the printless region irradiator 55 (the downstream-side irradiator 54) compared to a case where the printless region irradiator 55 (the downstream-side irradiator 54) overlaps the range of the downstream-side nozzle row 442 in the feeding direction. Accordingly, if the intermediate irradiator 53 that is side by side with the downstream-side nozzle row 442 is extinguished, dots formed by the downstream-side nozzle row 442 undergo almost no light irradiation immediately after formation. Thus, in a region facing the intermediate irradiator 53, dots wet and spread on the medium M gradually and is able to be smoothened, and it is possible to cure the dots having been smoothened with light from the printless region irradiator 55.

The controller 60 in the preferred embodiment(s) above causes the following pass and the feeding operation to be performed alternately in the glossy color printing mode (see FIG. 11), the pass involving: causing the upstream-side nozzle row 441 of the color nozzle row to discharge color inks and causing the downstream-side nozzle row 442 of the special ink nozzle row (for example, a transparent ink nozzle row, such as the gloss ink nozzle row) to discharge special ink (for example, transparent ink, such as gloss ink) while having the upstream-side irradiator 52 and the printless region irradiator 55 (the downstream-side irradiator 54) lit and the intermediate irradiator 53 extinguished. Accordingly, while bleeding is limited in the color image formed from color dots, a glossy layer with a smooth surface is able to be formed on the color image.

The controller 60 in the preferred embodiment(s) above causes the following pass and the feeding operation to be performed alternately in the smooth color printing mode (see FIG. 12) and the primer printing mode (see FIG. 13), the pass involving: causing the upstream-side nozzle row 441 and the downstream-side nozzle row 442 of the same nozzle row to discharge the same type of ink while having the upstream-side irradiator 52 and the printless region irradiator 55 (the downstream-side irradiator 54) lit and the intermediate irradiator 53 extinguished. Accordingly, even if part of the dots formed by the downstream-side nozzle row 442 are cured immediately after formation, these dots are not distinguishable from the dots formed by the upstream-side nozzle row 441 (dots that are cured immediately after formation), so image quality is not affected.

The controller 60 in the preferred embodiment(s) above causes the following pass and the feeding operation to be performed alternately in the smooth color printing mode (see FIG. 12), the pass involving: causing the upstream-side nozzle row 441 and the downstream-side nozzle row 442 of the color nozzle row to discharge color ink while having the upstream-side irradiator 52 and the printless region irradiator 55 (the downstream-side irradiator 54) lit and the intermediate irradiator 53 extinguished. Accordingly, bleeding of color dots is limited and a color image with a smooth surface is able to be formed.

The controller 60 in the preferred embodiment(s) above causes the following pass and the feeding operation to be performed alternately in the primer printing mode (see FIG. 13), the pass involving: causing the upstream-side nozzle row 441 and the downstream-side nozzle row 442 of the primer ink nozzle row to discharge primer ink while having the upstream-side irradiator 52 and the printless region irradiator 55 (the downstream-side irradiator 54) lit and the intermediate irradiator 53 extinguished. Accordingly, primer ink wets and spreads between cured dots, so primer ink (ground adjustment ink) that is applied so as to be smooth is able to be fixed on the medium M.

The printing apparatus in the aforementioned first preferred embodiment and reference example includes a feeder 30, a head 41, an irradiator 50, and a controller (controller) 60. The irradiator 50 is capable of radiating light onto a region longer in the feeding direction than a nozzle row 44. The controller 60 is capable of dividing the irradiator 50 into a printing region irradiator 51 and a printless region irradiator 55 (downstream-side irradiator 54) and individually controlling lighting and extinguishing of each of the irradiators defined by the division, when special ink (e.g., gloss ink, or the like) is discharged. In this preferred embodiment: the printing region irradiator 51 (the upstream-side irradiator 52 and the intermediate irradiator 53 corresponding to the nozzle row that discharges special ink) encompasses the range of the nozzle row 44 in the feeding direction; at least a portion of the printing region irradiator 51 on the downstream side in the feeding direction is disposed farther on the downstream side in the feeding direction than the downstream end of the nozzle row 44 in the feeding direction; and the downstream-side irradiator 54 is disposed farther on the downstream side in the feeding direction than the downstream end of the nozzle row 44 in the feeding direction (see FIGS. 9 and 19). As a result of such a configuration being used, when the printing region irradiator 51 is extinguished and the printless region irradiator 55 (the downstream-side irradiator 54) is lit in the special printing mode such as gloss printing mode, as illustrated in FIGS. 10B and 20B, then dots (e.g., gloss dots) formed with special ink discharged from the nozzles at the downstream end is able to be smoothened more easily compared to the second preferred embodiment.

In the first preferred embodiment and the reference example, as illustrated in FIGS. 9 and 19, radiation intensity (the radiation intensity P3 in FIG. 9 and the radiation intensity P4 in FIG. 19) of light at the downstream end of the nozzle row when the printing region irradiator 51 is extinguished and the printless region irradiator 55 (the downstream-side irradiator 54) is lit is lower than radiation intensity (the radiation intensity P2 in FIG. 9 and the radiation intensity Pmax in FIG. 19) of light at the downstream end of the nozzle row 44 when the printing region irradiator 51 is lit and the downstream-side irradiator 54 is extinguished. Thus, in this preferred embodiment, dots formed with special ink are able to be smoothened more easily in the special printing mode illustrated in FIGS. 10B and 20B.

The controller 60 in the first preferred embodiment causes, in mixed printing mode, the following pass and the feeding operation to be performed alternately, the pass involving: causing the upstream-side nozzle row 441 and the downstream-side nozzle row 442 to discharge special ink while having the upstream-side irradiator 52 and the downstream-side irradiator 54 lit and the intermediate irradiator 53 extinguished (see FIG. 13). Accordingly, it is possible to implement printing by mixing dots cured immediately after being formed and dots cured after being smoothened. In addition, in this preferred embodiment, at least a portion of the printing region irradiator 51 on the downstream side in the feeding direction is disposed farther on the downstream side in the feeding direction than the downstream end of the nozzle row 44, and the downstream-side irradiator 54 is disposed farther on the downstream side in the feeding direction than the downstream end of the nozzle row 44; accordingly, special dots with a smooth surface may be formed stably.

In the reference example, the color ink nozzle row 44A and the special ink nozzle row 44B are provided as the nozzle row, and the special ink nozzle row 44B is disposed farther on the upstream side in the feeding direction than the color ink nozzle row 44A. In this way, by disposing the color ink nozzle row 44A and the special ink nozzle row 44B in staggered fashion, the number of nozzles in the nozzle row is able to be reduced compared to the first preferred embodiment. Furthermore, in the reference example, while this staggered disposition being used, the position of the boundary between the color ink nozzle row 44A and the special ink nozzle row 44B in the feeding direction is set to the central portion of the intermediate irradiator 53 and the downstream-side irradiator 54 encompass the range of the color ink nozzle row 44A in the feeding direction; accordingly, if the intermediate irradiator 53 and the downstream-side irradiator 54 are lit in the color printing mode, color dots can be cured immediately after formation. In the reference example, on the other hand, the upstream-side irradiator 52 and the intermediate irradiator 53 encompass the range of the special ink nozzle row 44B in the feeding direction. Accordingly, if the upstream-side irradiator and the intermediate irradiator 53 (the printing region irradiator 51) is extinguished and the downstream-side irradiator (the printless region irradiator 55) is lit in the special printing mode, special dots are able to be smoothened. In this way, in the reference example, by employing a staggered disposition, it is possible to reduce the number of nozzles and also make a color printing mode and a special printing mode compatible to be performed concurrently. Furthermore, in the reference example, as a result of using staggered disposition in which the special ink nozzle row 44B is disposed farther on the upstream side in the feeding direction than the color ink nozzle row 44A, the downstream-side irradiator 54 which radiates light onto color dots immediately after formation in color printing mode is able to be used as the printless region irradiator 55 in special printing mode.

In the aforementioned first preferred embodiment (and the reference example), when the printing region irradiator 51 is lit in color printing mode, as illustrated in FIG. 10A, then color dots formed at the downstream end of the nozzle row 44 is able to be cured immediately after formation more easily compared to the second preferred embodiment (see FIG. 18). Meanwhile, as has already been described, if the printing region irradiator 51 is extinguished and the printless region irradiator 55 is lit in special printing mode (e.g., gloss printing mode illustrated in FIG. 10B, for example), then gloss dots formed at the downstream end of the nozzle row 44 are able to be smoothened more easily compared to the second preferred embodiment. As such, in this preferred embodiment, color printing mode and special printing mode is able to be made compatible to be performed concurrently.

Moreover, in the first preferred embodiment (and the reference example), as illustrated in FIGS. 10A and 20, the controller 60 lights not only the printing region irradiator 51 but also the printless region irradiator 55 in color printing mode. Accordingly, color dots are able to be cured further with light leaking from the printless region irradiator 55. If the energy of light radiated onto the color dots is sufficient, however, the controller 60 may extinguish the downstream-side irradiator 54 during the color printing mode.

Other Preferred Embodiments

The preferred embodiments above are presented as mere examples and do not limit the scope of the present invention. The aforementioned configurations can be implemented in appropriate combinations and can be subject to a variety of omissions, substitutions, or modifications as long as the spirit of the present invention is maintained. The aforementioned preferred embodiments and variations thereof are encompassed in the scope and the spirit of the present invention and are likewise encompassed in the present invention set forth in the claims and equivalents thereof.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A printing apparatus comprising:

a feeder that feeds a medium in a feeding direction;

a head that at least includes a nozzle row in which a plurality of nozzles are located side by side in the feeding direction and that is movable in a scanning direction;

an irradiator that radiates light onto a region longer in the feeding direction than the nozzle row and that is movable in the scanning direction together with the head; and a controller that causes, in alternating fashion:

the head to move in the scanning direction and concurrently the nozzles to discharge ink while causing the irradiator to radiate the light; and the feeder to feed the medium in the feeding direction; wherein the controller is capable of dividing the nozzle row into an upstream-side nozzle row and a downstream-side nozzle row located on a downstream side in the feeding direction from the upstream-side nozzle row, and individually controlling discharge of ink from the nozzles of each of the upstream-side nozzle row and the downstream-side nozzle row;

the controller is capable of dividing the irradiator into an upstream-side irradiator, an intermediate irradiator adjacent to the upstream-side irradiator on a downstream side in the feeding direction, and a printless region irradiator adjacent to the intermediate irradiator on a downstream side in the feeding direction, and individually controlling lighting and extinguishing of each of the irradiators defined by the division;

the upstream-side irradiator overlaps a range of the upstream-side nozzle row in the feeding direction;

the intermediate irradiator overlaps a range of the downstream-side nozzle row in the feeding direction;

the printless region irradiator is located farther on a downstream side in the feeding direction than the downstream-side nozzle row without overlapping the range of the downstream-side nozzle row in the feeding direction; and the controller performs, in alternating fashion, an operation and control to cause the feeder to feed the medium in the feeding direction and to cause the head to move in the scanning direction and concurrently cause the nozzles of the upstream-side nozzle row and the downstream-side nozzle row to discharge ink while having the upstream-side irradiator lit, the intermediate irradiator extinguished, and the printless region irradiator lit.

2. The printing apparatus according to claim 1, wherein the nozzle row is provided in a plurality, the plurality of the nozzle rows at least including a color ink nozzle row and a special ink nozzle row;

the controller performs, in alternating fashion, an operation and control to cause the feeder to feed the medium in the feeding direction and to cause the head to move in the scanning direction and concurrently cause the nozzles of the upstream-side nozzle row of the color ink nozzle row to discharge color ink and nozzles of the downstream-side nozzle row of the special ink nozzle row to discharge special ink while having the upstream-side irradiator lit, the intermediate irradiator extinguished, and the printless region irradiator lit.

3. The printing apparatus according to claim 1, wherein the controller performs, in alternating fashion an operation and control to cause the feeder to feed the medium in the feeding direction and cause the head to move in the scanning direction and concurrently cause the nozzles of the upstream-side nozzle row and the downstream-side nozzle row included in a single nozzle row to discharge identical ink while having the upstream-side irradiator lit, the intermediate irradiator extinguished, and the printless region irradiator lit.

4. The printing apparatus according to claim 3, wherein the controller performs, in alternating fashion, an operation and control to cause the feeder to feed the medium in the feeding direction and to cause the nozzles of the upstream-side nozzle row and the downstream-side nozzle row of the color ink nozzle row from among the plurality of the nozzle rows to discharge color ink while having the upstream-side irradiator lit, the intermediate irradiator extinguished, and the printless region irradiator lit.

5. The printing apparatus according to claim 3, wherein the controller performs, in alternating fashion, an operation and control to cause the feeder to feed the medium in the feeding direction and to cause the nozzles of the upstream-side nozzle row and the downstream-side nozzle row of the special ink nozzle row from among the plurality of the nozzle rows to discharge special ink while having the upstream-side irradiator lit, the intermediate irradiator extinguished, and the printless region irradiator lit.

6. The printing apparatus according to claim 1, wherein the nozzle row includes a color ink nozzle row that discharges color ink and a special ink nozzle row that discharges special ink;

the controller is capable of dividing the irradiator into a printing region irradiator and a printless region irradiator adjacent to the printing region irradiator on a downstream side in the feeding direction and individually controlling lighting and extinguishing of each of the irradiators defined by the division, when the special ink is discharged from the nozzles of the special ink nozzle row;

the printing region irradiator encompasses a range of the special ink nozzle row in the feeding direction;

at least a portion of the printing region irradiator on a downstream side in the feeding direction is located farther on a downstream side in the feeding direction than a downstream end of the special ink nozzle row in the feeding direction;

the printless region irradiator is located farther on a downstream side in the feeding direction than a downstream end of the nozzle row in the feeding direction; and when causing the nozzles of the special ink nozzle row to discharge the special ink, the controller extinguishes the printing region irradiator and lights the printless region irradiator.

7. The printing apparatus according to claim 6, wherein a radiation intensity of the light at the downstream end of the special ink nozzle row in the feeding direction when the printing region irradiator is extinguished and the printless region irradiator is lit is smaller than a radiation intensity of the light at the downstream end when the printing region irradiator is lit and the printless region irradiator is extinguished.

8. The printing apparatus according to claim 6, wherein the controller is capable of dividing the special ink nozzle row into an upstream-side nozzle row and a downstream-side nozzle row located on a downstream side in the feeding direction from the upstream-side nozzle row, and individually controlling discharge of the special ink from the nozzles of each of the upstream-side nozzle row and the downstream-side nozzle row;

the printing region irradiator is divided into an upstream-side irradiator and an intermediate irradiator adjacent to the upstream-side irradiator on a downstream side in the feeding direction;

the controller is capable of individually controlling lighting and extinguishing of each of the upstream-side irradiator, the intermediate irradiator, and the printless region irradiator;

the upstream-side irradiator overlaps a range of the upstream-side nozzle row in the feeding direction;

the intermediate irradiator overlaps a range of the downstream-side nozzle row in the feeding direction; and the controller performs, in alternating fashion, an operation and control to cause the feeder to feed the medium in the feeding direction, and to cause the head to move in the scanning direction and concurrently cause the nozzles of the upstream-side nozzle row and the downstream-side nozzle row to discharge the special ink while having the upstream-side irradiator lit, the intermediate irradiator extinguished, and the printless region irradiator lit.

9. The printing apparatus according to claim 6, wherein when causing the nozzles to discharge color ink, the controller lights the printing region irradiator and the printless region irradiator.

* * * * *